US010465955B2

(12) United States Patent
Inoue et al.

(10) Patent No.: US 10,465,955 B2
(45) Date of Patent: Nov. 5, 2019

(54) HEAT EXCHANGER AND AIR CONDITIONING APPARATUS

(71) Applicant: DAIKIN INDUSTRIES, LTD., Osaka-shi, Osaka (JP)

(72) Inventors: Satoshi Inoue, Sakai (JP); Masanori Jindou, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/513,866

(22) PCT Filed: Sep. 24, 2015

(86) PCT No.: PCT/JP2015/076926

§ 371 (c)(1),
(2) Date: Mar. 23, 2017

(87) PCT Pub. No.: WO2016/052299

PCT Pub. Date: Apr. 7, 2016

(65) Prior Publication Data

US 2017/0292741 A1 Oct. 12, 2017

(30) Foreign Application Priority Data

Sep. 30, 2014 (JP) ..... 2014-202334

(51) Int. Cl.
*F25B 39/00* (2006.01)
*F28F 9/02* (2006.01)
(Continued)

(52) U.S. Cl.
CPC ..... *F25B 39/00* (2013.01); *F24F 1/18* (2013.01); *F25B 13/00* (2013.01); *F28D 1/047* (2013.01);
(Continued)

(58) Field of Classification Search
CPC ..... F28D 1/05325; F28D 1/05333; F28D 1/05341; F28D 1/05375; F28D 1/05383;
(Continued)

(56) References Cited

U.S. PATENT DOCUMENTS 2,099,186 A * 11/1937 Anderegg ..... F25B 39/028 165/110
5,203,407 A * 4/1993 Nagasaka ..... F28D 1/05375 165/174
(Continued)

FOREIGN PATENT DOCUMENTS

JP 2-219966 A 9/1990
JP 11-337293 A 12/1999
(Continued)

OTHER PUBLICATIONS

Decision to Grant a Patent of corresponding JP Application No. 2014-202334 dated Oct. 29, 2015.
(Continued)

*Primary Examiner* — Travis C Ruby
(74) *Attorney, Agent, or Firm* — Global IP Counselors, LLP

(57) ABSTRACT

A heat exchanger includes a plurality of flat tubes, a header part, and a guide part. An interior of the header part is partitioned into first and second spaces. One end of each of the tubes is connected to the first space. The guide part has a guide space positioned below the first space. The guide space communicates with the first space via an ascending opening. The first and second spaces communicate with each other via upper and lower communication ports provided within upper and lower sides of the header part, respectively. When the heat exchanger is viewed from above after installation, the tubes and the ascending opening have an area of overlap, and the ascending opening and a space where the lower communication port is extended do not overlap or
(Continued)

have an area of overlap that is up to 50% of the ascending opening.

18 Claims, 11 Drawing Sheets

(51) Int. Cl.

| | |
|---|---|
| ***F24F 1/18*** | (2011.01) |
| ***F28D 1/053*** | (2006.01) |
| ***F25B 13/00*** | (2006.01) |
| ***F28F 1/32*** | (2006.01) |
| ***F28D 1/047*** | (2006.01) |
| *F28D 21/00* | (2006.01) |

(52) U.S. Cl.
CPC ..... *F28D 1/053* (2013.01); *F28D 1/05391* (2013.01); *F28F 1/325* (2013.01); *F28F 9/02* (2013.01); *F28F 9/0202* (2013.01); *F28F 9/027* (2013.01); *F28F 9/0207* (2013.01); *F28F 9/028* (2013.01); *F28F 9/0212* (2013.01); *F28F 9/0224* (2013.01); *F28F 9/0243* (2013.01); *F28F 9/0275* (2013.01); *F28D 2021/0068* (2013.01); *F28F 2215/12* (2013.01); *F28F 2225/08* (2013.01)

(58) Field of Classification Search
CPC ..... F28D 1/05391; F28F 9/0209; F28F 2009/226; F28F 9/0207
USPC ..... 165/139, 174
See application file for complete search history.

(56) References Cited

U.S. PATENT DOCUMENTS 5,743,329 A * 4/1998 Damsohn ..... F28D 1/05383 165/153
6,688,137 B1 * 2/2004 Gupte ..... F25B 39/022 62/515
2003/0010484 A1 * 1/2003 Chikuma ..... F28F 9/0212 165/174
2005/0006070 A1 * 1/2005 Kamiyama ..... F28D 1/0443 165/140
2008/0023185 A1 * 1/2008 Beamer ..... F28D 1/05375 165/174
2009/0025914 A1 * 1/2009 Knight ..... F25B 39/00 165/144
2010/0314090 A1 12/2010 Moriya et al.
2014/0123696 A1 5/2014 Kim et al.
2014/0311703 A1 * 10/2014 Takagi ..... F28F 9/0207 165/41
2014/0338874 A1 * 11/2014 Jindou ..... F28F 9/0204 165/173
2015/0021003 A1 * 1/2015 Cho ..... F28F 9/0212 165/145
2015/0053383 A1 * 2/2015 Citti ..... F28F 9/0212 165/173

FOREIGN PATENT DOCUMENTS

JP 2009-41876 A 2/2009
JP 2013-137193 A 7/2013
JP WO 2014188714 A1 * 11/2014 ..... F25B 39/028
WO 2007/094422 A1 8/2007

OTHER PUBLICATIONS

International Preliminary Report of corresponding PCT Application No. PCT/JP2015/076926 dated Apr. 13, 2017.
International Search Report of corresponding PCT Application No. PCT/JP2015/076926 dated Nov. 10, 2015.
European Search Report of corresponding EP Application No. 15 84 7695.2 dated May 14, 2018.

* cited by examiner

HEAT EXCHANGER AND AIR CONDITIONING APPARATUS

TECHNICAL HELD

The present invention relates to a heat exchanger and an air conditioning apparatus.

CROSS-REFERENCE TO RELATED APPLICATIONS

This U.S. National stage application claims priority under 35 U.S.C. § 119(a) to Japanese Patent Application No. 2014-202334, filed in Japan on Sep. 30, 2014, the entire contents of which are hereby incorporated herein by reference.

BACKGROUND ART

In the prior art, there are well-known heat exchangers that are provided with a plurality of flat tubes, fins that are joined to the plurality of flat tubes, and header collecting tubes respectively connected to a first end side and another end side of the plurality of flat tubes. In these heat exchangers, heat is exchanged between refrigerant flowing through the interior of the flat tubes and air passing the exterior of the flat tubes.

For example, in the heat exchanger disclosed in Japanese Laid-open Patent Publication No. H02-219966, a configuration is adopted in which both ends of a plurality of outflow tubes that extend in a horizontal direction are respectively connected to header collecting tubes that extend in a vertical direction.

The heat exchanger disclosed in Japanese Laid-open Patent Publication No. H02-219966 addresses the problem that, within the header collecting tubes that extend in the vertical direction, liquid phase refrigerant having a high specific gravity collects at the lower part and gas phase refrigerant having a low specific gravity collects at the upper part, whereby an unevenly distributed flow is generated. In order to solve this problem, a configuration is proposed in which a throttle is formed within the header collecting tubes.

Passing the refrigerant through the throttle formed in this manner facilitates mixing of the gas phase refrigerant and the liquid phase refrigerant, while at the same time increases the flow rate, making it easy for the refrigerant to be caused to reach the upper part within the header collecting tubes, thereby minimizing unevenly distributed flow of the refrigerant.

SUMMARY

Technical Problem

However, in the heat exchanger illustrated in Japanese Laid-open Patent Publication No. H02-219966 as described above, no consideration whatsoever has been given to minimizing unevenly distributed flow in cases of use under conditions of varied refrigerant circulation rate, and there has been no investigation into a structure by which the effect for minimizing unevenly distributed flow is obtained irrespective of whether low circulation rates, high circulation rates, or both occur.

Specifically, in a case of a low circulation rate, forming the throttle increases the flow rate, allowing the refrigerant to reach the upper part within the header collecting tubes, thereby making it possible to minimize unevenly distributed flow. However, in a case of a high circulation rate, the flow rate increases too much due to the throttle, and therefore too much of the liquid phase refrigerant having a high specific gravity collects at the top, and an unevenly distributed flow results instead.

However, even when the degree of throttle is adjusted so that the flow rate does not increase too much in a case of a high circulation rate, thereby making it possible to minimize unevenly distributed flow when the circulation rate is high, it will be difficult for the refrigerant to be caused to reach the top in a case of a low circulation rate, and an unevenly distributed flow may still be generated.

By contrast, a configuration has been considered in which a refrigerant loop structure in the headers is employed, such that when the circulation rate is low, the refrigerant is facilitated in reaching the top, while when the circulation rate is high, refrigerant having reached the top is caused to move from the corresponding ascending space to another space and descend, and is subsequently caused to ascend again. In such a loop structure, it is possible to provide an upper communication port via which the refrigerant that has ascended in the ascending space is allowed to move to a descending space, and a lower communication port (return hole) for returning the refrigerant that has descended in the descending space to the ascending space again.

However, the inventors discovered that, in the lower communication port (return hole), no following current flowing from the descending space to the ascending space was produced, and there was a risk that a reverse current flowing from the ascending space toward the descending space could be produced.

The present invention was contrived in view of the foregoing, it being a purpose of the present invention to provide a heat exchanger and an air conditioning apparatus with which it is possible to minimize unevenly distributed flow of refrigerant and minimize reverse current of the refrigerant flowing from the ascending space toward the descending space even in cases of use under conditions such that the circulation rate of the refrigerant varies.

Solution to Problem

A heat exchanger according to a first aspect of the present invention is provided with a plurality of flat tubes, a header part, and a guide part. The plurality of flat tubes are arranged mutually side by side. The header part extends upward so as to follow the direction in which the plurality of flat tubes are arranged side by side, the interior of the header part being partitioned into a first space and a second space. One end of each of the plurality of flat tubes is connected to the first space. The plurality of flat tubes are not connected to the second space. The guide part has a guide space positioned below the first space. The guide space communicates with the first space via an ascending opening. The first space and the second space communicate with each other via an upper communication port and a lower communication port. The upper communication port is provided within the upper side of the header part. The lower communication port is provided within the lower side of the header part. When the heat exchanger is viewed from above after having been installed, the ascending opening and the plurality of flat tubes have an area of overlap. When the heat exchanger is viewed from above after having been installed, either the ascending opening and the space where the lower communication port is extended along the direction in which the flat tubes extend do not overlap, or the ascending opening and the space where the lower communication port is extended along the direction in which the flat tubes extend have an area of overlap, which is up to 50% of the ascending opening.

The upper communication port and/or the lower communication port may be configured so as to include a plurality of openings. The flat tubes may be connected to the guide space. The guide space may be configured in a widened manner so as not only to connect to the bottom of the first space, but also to span between the bottom of the first space and the bottom of the second space.

The plurality of flat tubes connected to the first space may be disposed with the ends being in alignment such that the first-space-inner-side ends are side by side in the vertical direction, or may be disposed without the ends being in alignment. In cases where the plurality of flat tubes are disposed with the ends on the inner side of the first space being in alignment, the ascending opening and all of the flat tubes are disposed such that there is at least some overlap when the heat exchanger is viewed from above after having been installed. In cases where the plurality of flat tubes are disposed without the ends on the inner side of the first space being in alignment, the ascending opening and a specific flat tube among the plurality of flat tubes are disposed such that there is at least some overlap when the heat exchanger is viewed from above after having been installed. In cases where the plurality of flat tubes are disposed without the ends on the inner side of the first space being in alignment, the flat tube that has the area of overlap with the ascending opening when the heat exchanger is viewed from above after having been installed is preferably positioned in the lower half of the first space, and is more preferably positioned in the lower one-third of the first space.

In the heat exchanger according to the aspect described above, the internal space of the header part is partitioned into a first space and a second space. Therefore, the area through which the refrigerant passes when the refrigerant is to pass through the ascending opening and ascend can be reduced to only the first space, in contrast to when the internal space is not partitioned. Therefore, it is possible to minimize any reduction in the flow rate of the refrigerant ascending through the first space. In a case where this heat exchanger is used in a refrigerating apparatus provided with a refrigerant circuit, it will be easy for the refrigerant to be caused to reach the upper part or top within the header collecting tubes even when the flow rate of the refrigerant passing through the ascending opening is low and the velocity at which the refrigerant having passed through the ascending opening contacts the flat tubes decreases, such as in a case where the circulation rate of the refrigerant in the refrigerant circuit is low.

In the heat exchanger according to the aspect described above, the plurality of flat tubes and the ascending opening have an area of overlap when the heat exchanger is viewed from above after having been installed. Therefore, in a case where the flow rate at which the refrigerant has passed through the ascending opening is high, such as in a case where the circulation rate of the refrigerant in the refrigerant circuit is high, it is possible to cause the refrigerant to make violent contact with the flat tubes and agitate the gas phase refrigerant and the liquid phase refrigerant. Therefore, when the circulation rate is high, the refrigerant can be more evenly supplied to both the flat tubes positioned at the top within the first space and the flat tubes positioned at the bottom within the first space.

In a case where the flow rate at which the refrigerant has passed through the ascending opening is low, such as in a case where the circulation rate of the refrigerant in the refrigerant circuit is low, the refrigerant is caused to make contact with the flat tubes more gently, and therefore it is easy for the refrigerant to be caused to reach the upper part within the first space without losing much momentum when ascending. Therefore, even when the circulation rate is low, the refrigerant can be more evenly supplied to both the flat tubes positioned at the top within the first space and the flat tubes positioned at the bottom within the first space.

In the heat exchanger according to the aspect described above, in cases where the heat exchanger functions as an evaporator for the refrigerant, even when the flow rate at which the refrigerant has passed through the ascending opening is high enough that the liquid phase refrigerant diverges upward merely by the refrigerant being caused to make violent contact with the flat tubes, such as in a case of a high circulation rate, this divergence can be reduced by furthermore providing an upper communication port and a lower communication port. Specifically, in this heat exchanger, the liquid phase refrigerant having reached the upper part of the first space after the refrigerant is caused to make violent contact with the flat tubes can be guided into the second space via the upper communication port and caused to descend through the second space, after which the refrigerant can be returned to the first space via the lower communication port. Accordingly, even in cases where the flow rate at which the refrigerant has passed through the ascending opening is high such as in a case of a high circulation rate, and the liquid phase refrigerant is likely to diverge upward even when the refrigerant having passed through the ascending opening is caused to make contact with the flat tubes, it will be possible to keep unevenly distributed flow of the refrigerant flowing within the plurality of flat tubes to a minimum.

In the heat exchanger according to the aspect described above, when the heat exchanger is viewed from above after having been installed, either the ascending opening and the space where the lower communication port is extended along the direction in which the flat tubes extend do not overlap, or the ascending opening and the space where the lower communication port is extended along the direction in which the flat tubes extend have an area of overlap that is up to 50% of the ascending opening. This arrangement makes it more difficult for the refrigerant having passed through the ascending opening from the guide space and ascended toward the first space to form a reverse current from the first space toward the second space via the lower communication port.

This makes it possible to minimize unevenly distributed flow of the refrigerant even when the refrigerant circulation rate varies, and to minimize reverse current from the first space toward the second space via the lower communication port.

A heat exchanger according to a second aspect of the present invention is the heat exchanger according to the first aspect of the present invention, wherein the ascending opening and/or the lower communication port is configured so as to include a plurality of ports positioned so as to be set apart from each other. The port that is configured so as to include a plurality of ports may be only the ascending opening, or may be only the lower communication port. Alternatively, both the ascending opening and the lower communication port may be configured so as to include a plurality of ports.

In the heat exchanger according to the aspect described above, the ascending opening and/or the lower communication port are/is constituted by a plurality of ports. Therefore, it will be possible to keep divergence of the distribution of refrigerant less than when there is one port.

A heat exchanger according to a third aspect of the present invention is the heat exchanger according to the second aspect of the present invention, wherein each of the plurality of flat tubes has a plurality of inflow ports arranged side by side in a horizontal direction in the ends within the first space. With respect to the space where the lower communication port is extended along the direction in which the flat tubes extend, the ascending opening includes a first ascending opening provided to one side of the space and a second ascending opening provided to the other side of the space when the heat exchanger is viewed from above after having been installed.

In the heat exchanger according to the aspect described above, some of the refrigerant flowing into the first space from the guide space passes through the first ascending opening, and the rest of the refrigerant passes through the second ascending opening. Therefore, it will be possible to send refrigerant to both the one side and the other side of the space where the lower communication port is extended along the direction in which the flat tubes extend. Accordingly, it will be possible to minimize any variance in the amounts of refrigerant fed to the plurality of inflow ports arranged side by side in the ends of the flat tubes.

A heat exchanger according to a fourth aspect of the present invention is the heat exchanger according to any of the first to third aspects of the present invention, wherein the lower end of the lower communication port is positioned further downward than is the lower end of a lowest-stage flat tube. The lowest-stage flat tube is the flat tube arranged furthest downward above the ascending opening among the plurality of flat tubes connected to the first space.

The upper end of the lower communication port is preferably positioned further downward than is the lower end of the lowest-stage flat tube.

In the heat exchanger according to the aspect described above, in a state in which the refrigerant having passed through the ascending opening and flowed upward ascends until colliding with the lowest-stage flat tube, the refrigerant will already have passed the lower end of the lower communication port and been positioned higher. Therefore, even when the refrigerant having passed through the ascending opening collides with the lowest-stage flat tube, the refrigerant is not likely to flow toward the lower communication port, and reverse current of the refrigerant via the lower communication port can be more effectively minimized.

In a configuration in which the upper end of the lower communication port is positioned further downward than is the lower end of the lowest-stage flat tube, reverse current of the refrigerant via the lower communication port can be even more effectively minimized.

A heat exchanger according to a fifth aspect of the present invention is the heat exchanger according to any of the first to fourth aspects of the present invention, wherein the heat exchanger is furthermore provided with a guide partition member. The header part has a header partition member for partitioning the first space and the second space. The guide partition member partitions the guide space and the first space of the header part. The upper surface of the guide partition member includes a portion in contact with the header partition member. The ascending opening is provided so as to pass through the guide partition member in the plate-thickness direction at a position set apart from the position of contact between the guide partition member and the header partition member.

In the heat exchanger according to the aspect described above, the ascending opening is provided at a position set apart from the position of contact between the guide partition member and the header partition member; therefore, even in cases where the heat exchanger is manufactured through brazing, the brazing material is not likely to reach the position of the ascending opening and it will be possible to minimize obstruction of the ascending opening.

An air conditioning apparatus according to a sixth aspect of the present invention is provided with a refrigerant circuit. The refrigerant circuit is constituted by connecting the heat exchanger according to any of the first to fifth aspects of the present invention, and a variable-capacity compressor.

With this air conditioning apparatus, driving by the variable-capacity compressor causes the circulation rate of the refrigerant flowing through the refrigerant circuit to fluctuate, and the amount of refrigerant passing through the heat exchanger to fluctuate. In cases where the heat exchanger functions as an evaporator, it will be possible to keep unevenly distributed flow of the refrigerant within the heat exchanger to a minimum, even when the amount of the refrigerant passing therethrough increases and the mixture ratio of liquid phase refrigerant increases, or the flow rate increases.

Advantageous Effects of Invention

With the heat exchanger according to the first aspect of the present invention it is possible to minimize unevenly distributed flow of the refrigerant even when the refrigerant circulation rate varies, and to minimize reverse current of the refrigerant from the first space toward the second space via the lower communication port.

With the heat exchanger according to the second aspect of the present invention, it is possible to keep divergence of the distribution of refrigerant less than when there is one port.

With the heat exchanger according to the third aspect of the present invention, it is possible to minimize any variance in the amounts of refrigerant fed to the plurality of inflow ports arranged side by side in the ends of the flat tubes.

With the heat exchanger according to the fourth aspect of the present invention, it is possible to more effectively minimize reverse current of the refrigerant via the lower communication port.

With the heat exchanger according to the fifth aspect of the present invention, it is possible to minimize obstruction of the ascending opening.

With the air conditioning apparatus according to the sixth aspect of the present invention, in cases where the heat exchanger functions as an evaporator, it is possible to keep unevenly distributed flow of the refrigerant within the heat exchanger to a minimum, even when the amount of the refrigerant passing therethrough increases and the mixture ratio of liquid phase refrigerant increases, or the flow rate increases.

DESCRIPTION OF EMBODIMENTS

(1) Overall Configuration of Air Conditioning Apparatus 1

Figure 1:
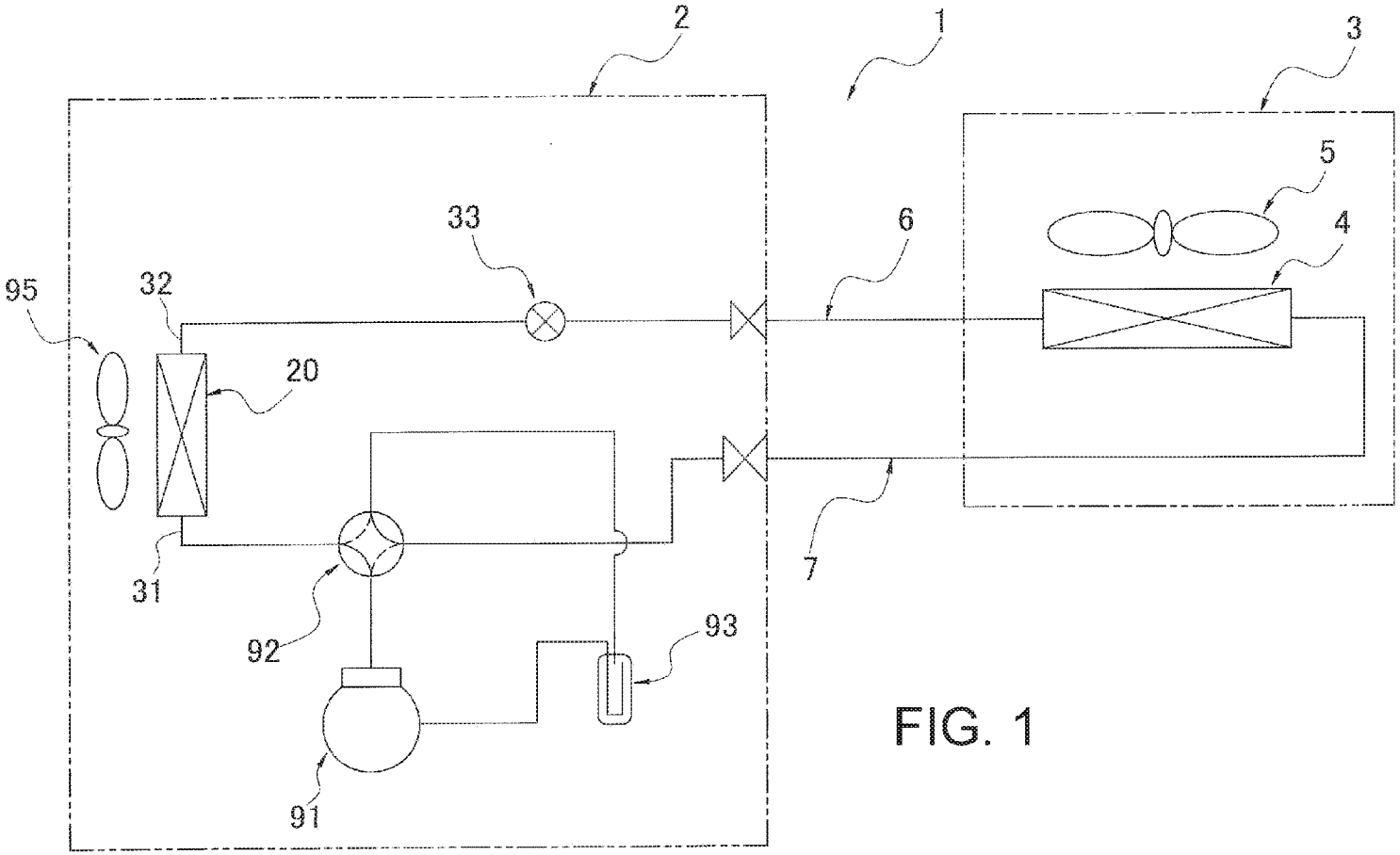
FIG. 1 is a circuit diagram used to schematically depict an air conditioning apparatus according to a first embodiment.

FIG. 1 is a circuit diagram used to schematically depict an air conditioning apparatus 1 according to a first embodiment of the present invention.

This air conditioning apparatus 1 is a device used for cooling and heating, through vapor compression refrigerating cycle operation, of a building interior in which an air conditioning indoor unit 3 has been installed, and is constituted by an air conditioning outdoor unit 2 as a heat source-side unit and the air conditioning indoor unit 3 as a usage-side unit, which are connected by refrigerant interconnecting pipelines 6, 7.

The refrigerant circuit constituted by connection of the air conditioning outdoor unit 2, the air conditioning indoor unit 3, and the refrigerant interconnecting pipelines 6, 7 is further constituted by connecting a compressor 91, a four-way switching valve 92, an outdoor heat exchanger 20, an expansion valve 33, an indoor heat exchanger 4, an accumulator 93, and the like, through refrigerant pipelines. A refrigerant is sealed within this refrigerant circuit, and refrigerating cycle operation involving compression, cooling, depressurization, and heating/evaporation of the refrigerant, followed by re-compression, is carried out. As the refrigerant, there may be employed one selected, for example, from R410A, R32, R407C, R22, R134a, carbon dioxide, and the like.

(2) Detailed Configuration of Air Conditioning Apparatus 1

(2-1) Air Conditioning Indoor Unit 3

The air conditioning indoor unit 3 is installed by being wall-mounted on an indoor wall or the like, or by being recessed within or suspended from an indoor ceiling of a building or the like. The air conditioning indoor unit 3 includes the indoor heat exchanger 4 and an indoor fan 5. The indoor heat exchanger 4 is, for example, a fin-and-tube heat exchanger of cross fin type, constituted by a heat transfer tube and a multitude of fins. In cooling operation, the heat exchanger functions as an evaporator for the refrigerant to cool the indoor air, and in heating operation functions as a condenser for the refrigerant to heat the indoor air.

(2-2) Air Conditioning Outdoor Unit 2

Figure 2:
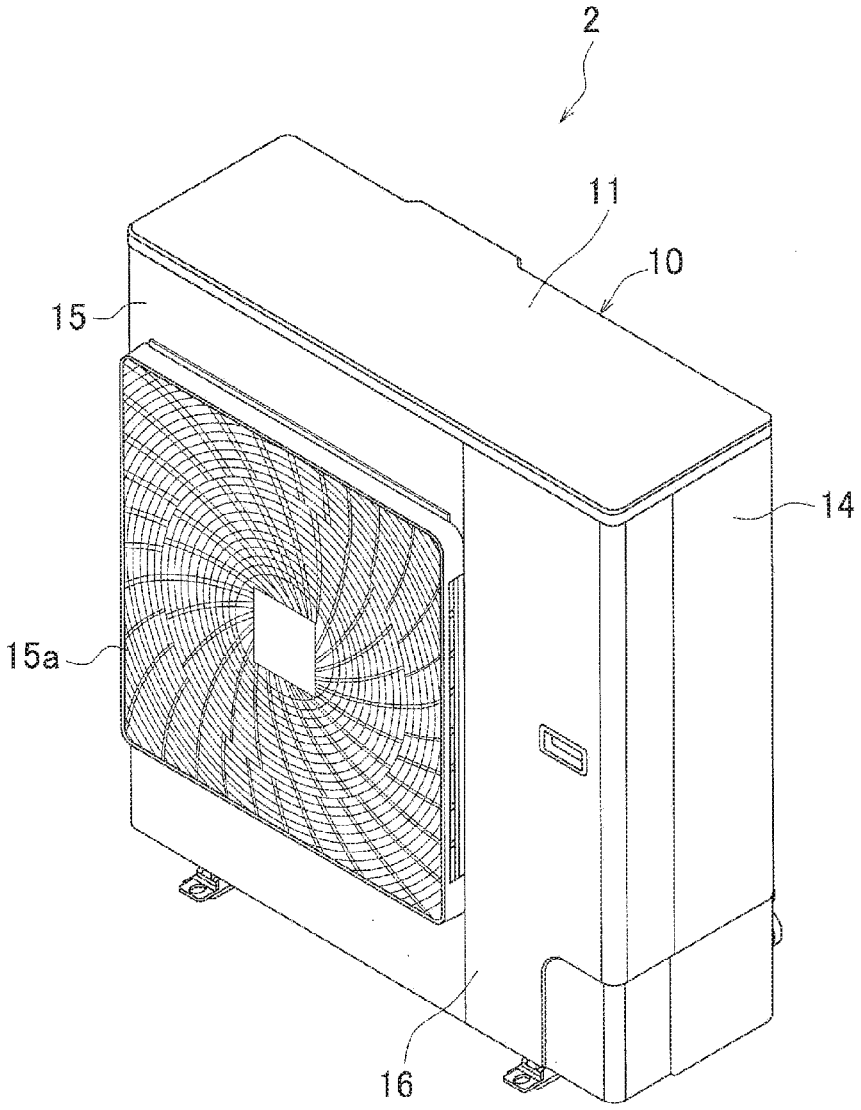
FIG. 2 is a perspective view of the exterior of an air conditioning outdoor unit.
Figure 3:
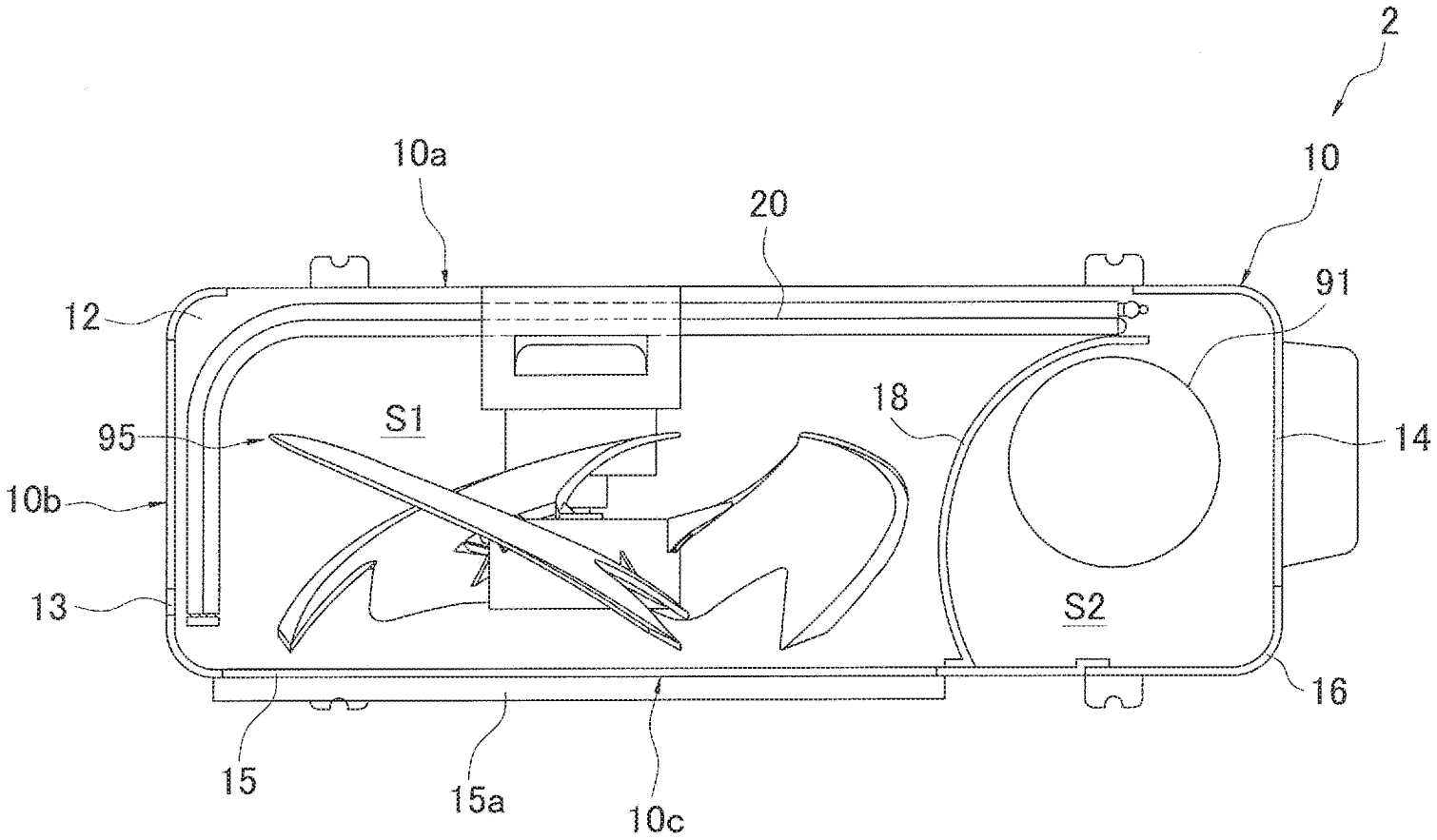
FIG. 3 is a schematic top cross-sectional view of the arrangement of devices of the air conditioning outdoor unit.

The air conditioning outdoor unit 2 is installed outside a building or the like, and is connected to the air conditioning indoor unit 3 by the refrigerant interconnecting pipelines 6, 7. As shown in FIG. 2 and FIG. 3, the air conditioning outdoor unit 2 has a unit casing 10 of substantially cuboid shape.

As shown in FIG. 3, the air conditioning outdoor unit 2 has a structure (a "trunk" type structure) in which a blower chamber S1 and a machinery chamber S2 are formed by dividing an internal space of the unit casing 10 into two by a partition panel 18 that extends in a vertical direction. The air conditioning outdoor unit 2 includes an outdoor heat exchanger 20 and an outdoor fan 95 which are arranged within the blower chamber S1 of the unit casing 10, and also includes the compressor 91, the four-way switching valve 92, the accumulator 93, the expansion valve 33, a gas refrigerant pipeline 31, and a liquid refrigerant pipeline 32 which are arranged within the machinery chamber S2 of the unit casing 10.

The unit casing 10 constitutes a chassis and is provided with a bottom panel 12, a top panel 11, a side panel 13 at the blower chamber side, a side panel 14 at the machinery chamber side, a blower chamber-side front panel 15, and a machinery chamber-side front panel 16.

The air conditioning outdoor unit 2 is configured in such a way that outdoor air is drawn into the blower chamber S1 within the unit casing 10 from parts of the rear surface and the side surface of the unit casing 10, and the suctioned outdoor air is vented from the front surface of the unit casing 10. In specific terms, an intake port 10*a* and an intake port 10*b* facing the blower chamber S1 within the unit casing 10 are formed between the rear face-side end of the side panel 13 at the blower chamber side and the blower chamber S1-side end of the side panel 14 at the machinery chamber side. The blower chamber-side front panel 15 is furnished with a vent 10*c*, the front side thereof being covered by a fan grill 15*a*.

The compressor 91 is, for example, a sealed compressor driven by a compressor motor, and is configured such that the operating capacity can be varied through inverter control.

The four-way switching valve 92 is a mechanism for switching the direction of flow of the refrigerant. In cooling operation, the four-way switching valve 92 connects a refrigerant pipeline from the discharge side of the compressor 91 and the gas refrigerant pipeline 31 which extends from a first end (the gas-side end) of the outdoor heat exchanger 20, as well as connecting, via the accumulator 93, the refrigerant interconnecting pipeline 7 for the gas refrigerant and the refrigerant pipeline at the intake side of the compressor 91 (see the solid lines of the four-way switching valve 92 in FIG. 1). In heating operation, the four-way switching valve 92 connects the refrigerant pipeline from the discharge side of the compressor 91 and the refrigerant interconnecting pipeline 7 for the gas refrigerant, as well as connecting, via the accumulator 93, the intake side of the compressor 91 and the gas refrigerant pipeline 31 which extends from the first end (the gas-side end) of the outdoor heat exchanger 20 (see the broken lines of the four-way switching valve 92 in FIG. 1).

The outdoor heat exchanger 20 is arranged upright in a vertical direction (perpendicular direction) in the blower chamber S1, and faces the intake ports 10*a*, 10*b*. The outdoor heat exchanger 20 is a heat exchanger made of aluminum; in the present embodiment, one having design pressure of about 3-4 MPa is employed. The gas refrigerant pipeline 31 extends from the first end (the gas-side end) of the outdoor heat exchanger 20, so as to connect to the four-way switching valve 92. The liquid refrigerant pipeline 32 extends from the other end (the liquid-side end) of the outdoor heat exchanger 20, so as to connect to the expansion valve 33.

The accumulator 93 is connected between the four-way switching valve 92 and the compressor 91. The accumulator 93 is equipped with a gas-liquid separation function for separating the refrigerant into a gas phase and a liquid phase. Refrigerant inflowing to the accumulator 93 is separated into the gas phase and the liquid phase, and the gas phase refrigerant which collects in the upper spaces is supplied to the compressor 91.

The outdoor fan 95 supplies the outdoor heat exchanger 20 with outdoor air for heat exchange with the refrigerant flowing through the outdoor heat exchanger 20.

The expansion valve 33 is a mechanism for depressurizing the refrigerant in the refrigerant circuit, and is an electrically-operated valve, the opening degree of which is adjustable. In order to make adjustments to the refrigerant pressure and the refrigerant flow rate, the expansion valve 33 is disposed between the outdoor heat exchanger 20 and the refrigerant interconnecting pipeline 6 for the liquid refrigerant, and has the function of expanding the refrigerant, both in air-cooling operation and air-warming operation.

The outdoor fan 95 is arranged facing the outdoor heat exchanger 20 in the blower chamber S1. The outdoor fan 95 sucks outdoor air into the unit, and after heat exchange between the outdoor air and the refrigerant has taken place in the outdoor heat exchanger 20, discharges the heat-exchanged air to the exterior. This outdoor fan 95 is a fan in which it is possible to adjust the airflow volume of the air supplied to the outdoor heat exchanger 20, and could be, for example, a propeller fan driven by a motor, such as a DC fan motor, or the like.

(3) Operation of Air Conditioning Apparatus 1

(3-1) Cooling Operation

In cooling operation, the four-way switching valve 92 assumes the state shown by the solid lines in FIG. 1, i.e., a state in which the discharge side of the compressor 91 is connected to the gas side of the outdoor heat exchanger 20 via the gas refrigerant pipeline 31, and the intake side of the compressor 91 is connected to the gas side of the indoor heat exchanger 4 via the accumulator 93 and the refrigerant interconnecting pipeline 7. The design of the expansion valve 33 is such that opening degree adjustments are made to maintain a constant degree of superheat (degree of superheat control) of the refrigerant at the outlet of the indoor heat exchanger 4 (i.e., the gas side of the indoor heat exchanger 4). With the refrigerant circuit in this state, when the compressor 91, the outdoor fan 95, and the indoor fan 5 are run, low-pressure gas refrigerant is compressed by the compressor 91 to become high-pressure gas refrigerant. This high-pressure gas refrigerant is fed to the outdoor heat exchanger 20 through the four-way switching valve 92. Subsequently, the high-pressure gas refrigerant undergoes heat exchange in the outdoor heat exchanger 20 with outdoor air supplied by the outdoor fan 95, and is condensed to become high-pressure liquid refrigerant. The high-pressure liquid refrigerant, now in a supercooled state, is fed to the expansion valve 33 from the outdoor heat exchanger 20. Refrigerant having been depressurized to close to the intake pressure of the compressor 91 by the expansion valve 33 and entered a low-pressure, gas-liquid two-phase state is fed to the indoor heat exchanger 4, and undergoes heat exchange with indoor air in the indoor heat exchanger 4, evaporating to become low-pressure gas refrigerant.

This low-pressure gas refrigerant is fed to the air conditioning outdoor unit 2 through the refrigerant interconnecting pipeline 7, and is again suctioned into the compressor 91. In this cooling operation, the air conditioning apparatus 1 prompts the outdoor heat exchanger 20 to function as a condenser for the refrigerant compressed in the compressor 91, and the indoor heat exchanger 4 to function as an evaporator for the refrigerant condensed in the outdoor heat exchanger 20.

In the refrigerant circuit during cooling operation, while degree of superheat control by the expansion valve 33 is taking place, the compressor 91 is inverter-controlled to a set temperature (such that the cooling load can be processed), and therefore the circulation rate of the refrigerant may be high in some cases, and low in others.

(3-2) Heating Operation

In heating operation, the four-way switching valve 92 assumes the state shown by broken lines in FIG. 1, i.e., a state in which the discharge side of the compressor 91 is connected to the gas side of the indoor heat exchanger 4 via the refrigerant interconnecting pipeline 7, and the intake side of the compressor 91 is connected to the gas side of the outdoor heat exchanger 20 via the gas refrigerant pipeline 31. The design of the expansion valve 33 is such that opening degree adjustments are made to maintain the degree of supercooling of the refrigerant at the outlet of the indoor heat exchanger 4 at a target degree of supercooling value (degree of supercooling control). With the refrigerant circuit in this state, when the compressor 91, the outdoor fan 95, and the indoor fan 5 are run, low-pressure gas refrigerant is suctioned into and compressed by the compressor 91 to become high-pressure gas refrigerant, and is fed to the air conditioning indoor unit 3 through the four-way switching valve 92 and the refrigerant interconnecting pipeline 7.

The high-pressure gas refrigerant fed to the air conditioning indoor unit 3 then undergoes heat exchange with indoor air in the indoor heat exchanger 4, is condensed to become high-pressure liquid refrigerant, and then while passing through the expansion valve 33 is depressurized to an extent commensurate with the opening degree of the expansion valve 33. The refrigerant having passed through the expansion valve 33 flows into the outdoor heat exchanger 20. The refrigerant in a low-pressure, gas-liquid two-phase state having flowed into the outdoor heat exchanger 20 undergoes heat exchange with outdoor air supplied by the outdoor fan 95, evaporates to become low-pressure gas refrigerant, and is again suctioned into the compressor 91 through the four-way switching valve 92. In this heating operation, the air conditioning apparatus 1 prompts the indoor heat exchanger 4 to function as a condenser for the refrigerant compressed in the compressor 91, and the outdoor heat exchanger 20 to function as an evaporator for the refrigerant condensed in the indoor heat exchanger 4.

In the refrigerant circuit during heating operation, while degree of supercooling control by the expansion valve 33 is taking place, the compressor 91 is inverter-controlled to a set temperature (such that the heating load can be processed), and therefore the circulation rate of the refrigerant may be high in some cases, and low in others.

(4) Detailed Configuration of the Outdoor Heat Exchanger 20

(4-1) Overall Configuration of the Outdoor Heat Exchanger 20

Figure 4:
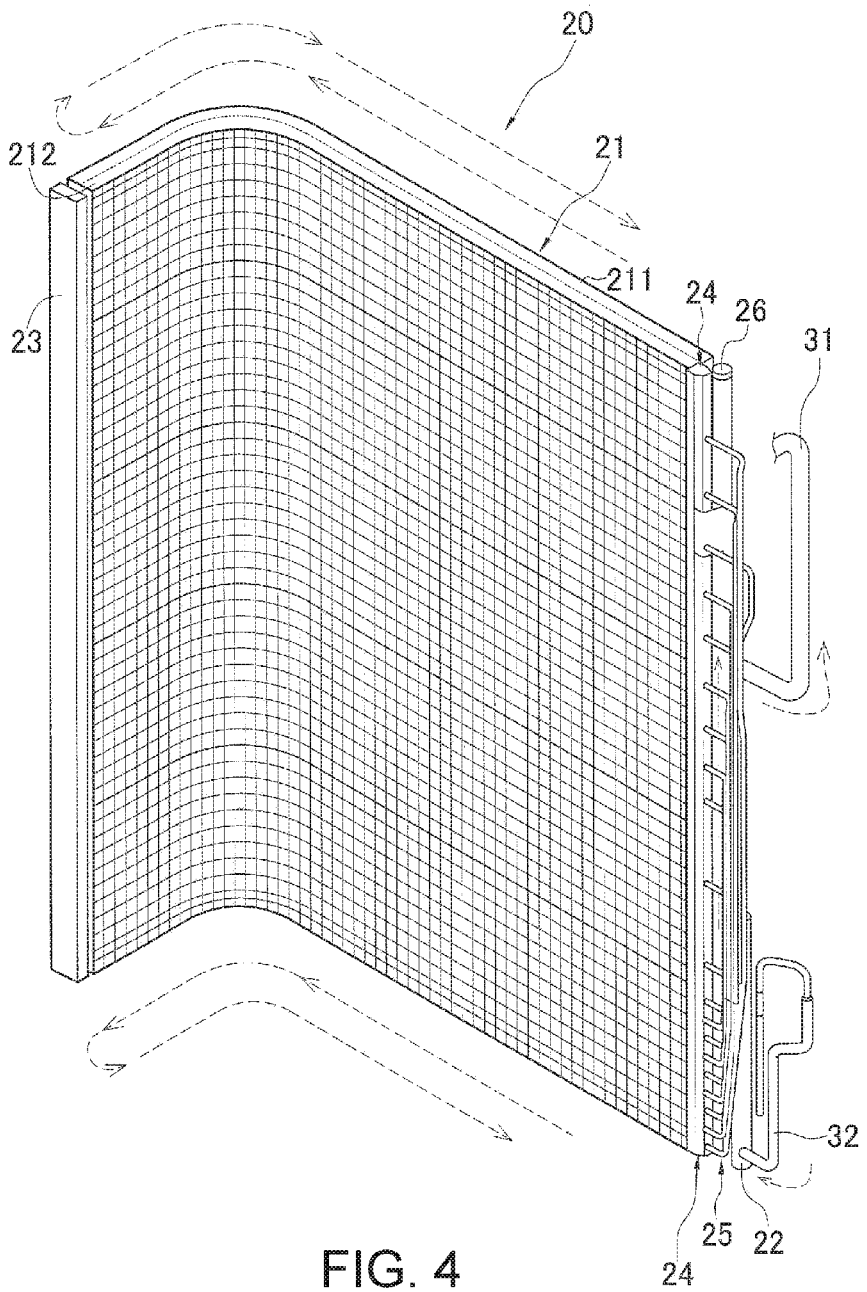
FIG. 4 is a schematic exterior perspective view of an outdoor heat exchanger.
Figure 5:
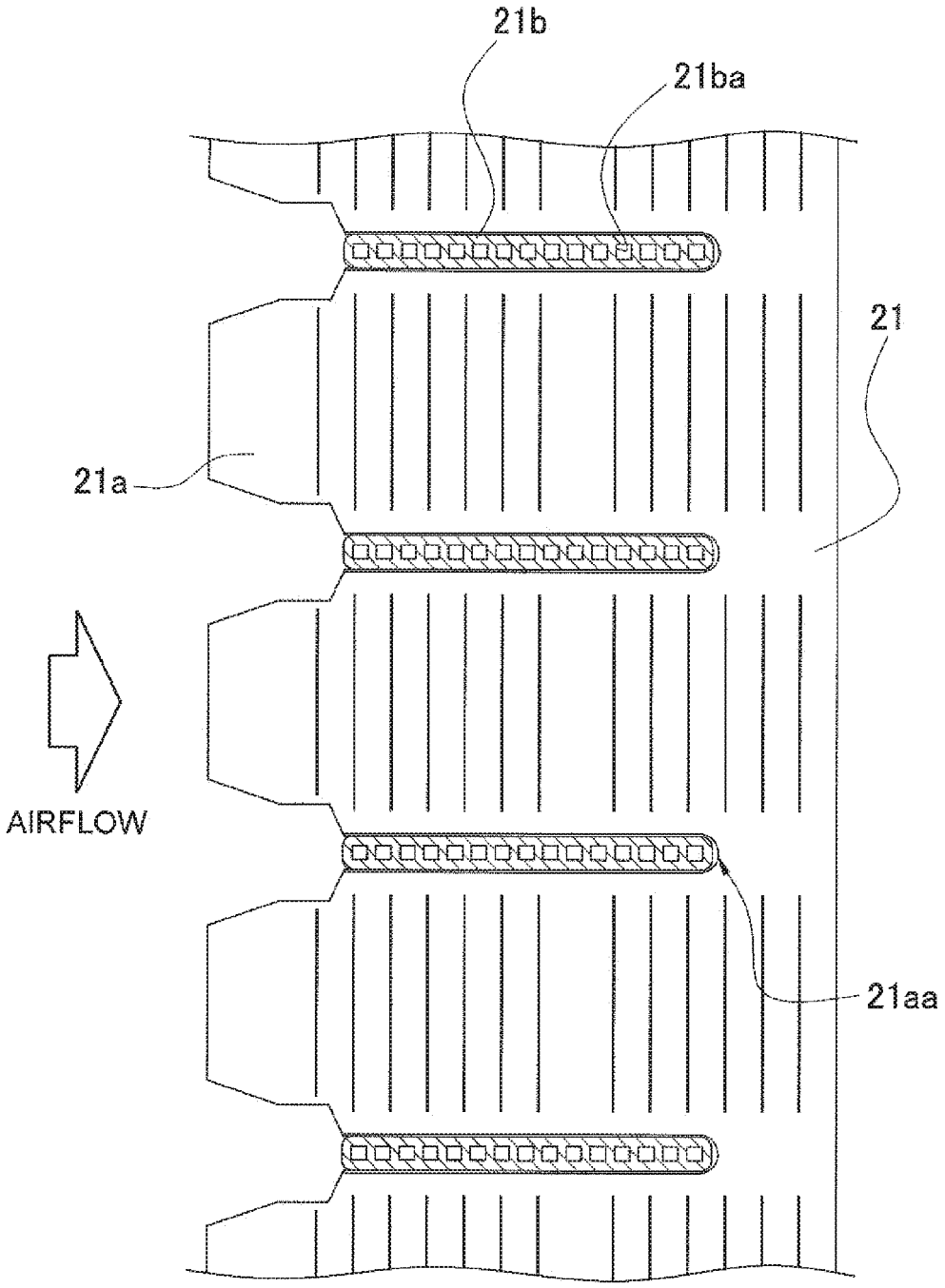
FIG. 5 is a schematic perspective view of a state of attachment of heat transfer fins to flat perforated tubes in the outdoor heat exchanger.

FIG. 4 is a schematic exterior perspective view of the outdoor heat exchanger 20. FIG. 5 is a schematic perspective view of a state of attachment of heat transfer fins 21*a* to flat perforated tubes 21*b*.

The outdoor heat exchanger 20 is provided with a heat exchange part 21 via which heat is exchanged between the outside air and the refrigerant, an outlet/inlet header collecting tube 26 and a folding-back header 24 provided to a first end of the heat exchange part 21, a connecting header 23 provided to the other end of the heat exchange part 21, an interconnecting part 25 for interconnecting the bottom of the folding-back header 24 and the top of the folding-back header 24, and a distributor 22 for guiding refrigerant that has been diverted to the bottom of the outlet/inlet header collecting tube 26.

(4-2) Heat Exchange Part 21

The heat exchange part 21 is constituted by a multitude of the heat transfer fins 21*a* and a multitude of the flat perforated tubes 21*b*. The heat transfer fins 21*a* and the flat perforated tubes 21*b* are both fabricated from aluminum or aluminum alloy.

The heat transfer fins 21*a* are flat members, and a plurality of cutouts 21*aa* extending in a horizontal direction for insertion of flat tubes are formed side by side in a vertical direction in the heat transfer fins 21*a*. The heat transfer fins 21*a* are attached so as to have innumerable sections protruding towards the upstream side of the air flow.

The flat perforated tubes 21*b* function as heat transfer tubes via which heat moving between the heat transfer fins 21*a* and the outside air is transferred to the refrigerant flowing through the interior. The flat perforated tubes 21*b* have vertical flat-surface parts that constitute heat transfer surfaces, and a plurality of inflow ports 21*ba*, formed side by side in a horizontal direction, through which the refrigerant flows. A plurality of flat perforated tubes 21*b* having this configuration are provided, and are arranged at prescribed intervals in the vertical direction. The flat perforated tubes 21*b*, configured so as to have a slightly greater vertical width than the cutouts 21*aa*, are aligned in a plurality of stages at intervals in a state in which the flat-surface parts are oriented vertically, and are provisionally secured by being fitted into the cutouts 21*aa*. With the flat perforated tubes 21*b* provisionally secured by being fitted into the cutouts 21*aa* of the heat transfer fins 21*a* in this manner, the heat transfer fins 21*a* and the flat perforated tubes 21*b* are brazed. Both ends of each of the flat perforated tubes 21*b* are brazed in a state of being fitted into the outlet/inlet header collecting tube 26, the folding-back header 24, and the connecting header 23.

As shown in FIG. 5, the heat transfer fins 21*a* link up vertically, and therefore any dew condensation occurring on the heat transfer fins 21*a* and/or the flat perforated tubes 21*b* will drip down along the heat transfer fins 21*a* and drain to the outside through a path formed in the bottom panel 12.

This heat exchange part 21 is configured by having, with respect to a direction of airflow produced by the outdoor fan 95 (flow from the rear surface and the left side surface of the chassis toward the fan grill 15*a* on the front surface of the chassis), an upstream-side heat exchange part 211 provided so as to border on an upstream side and a downstream-side heat exchange part 212 provided so as to border on a downstream side. The upstream-side heat exchange part 211 includes the plurality of flax perforated tubes 21*b* arranged side by side in a vertical direction extending so as to border on the upstream side, and the heat transfer fins 21*a* secured to these flat perforated tubes 21*b*. Similarly, the downstream-side heat exchange part 212 includes the plurality of flat perforated tubes 21*b* arranged side by side in a vertical direction extending so as to border on the downstream side, and the heat transfer fins 21*a* secured to these flat perforated tubes 21*b*.

(4-3) Distributor 22

The distributor 22 is connected such that the liquid refrigerant pipeline 32 and the lower portion of the outlet/inlet header collecting tube 26 are interconnected, the refrigerant having flowed from the liquid refrigerant pipeline 32 being diverted in a height direction by the distributor 22 and guided to the lower portion of the outlet/inlet header collecting tube 26 when the outdoor heat exchanger 20 functions as an evaporator for the refrigerant.

(4-4) Outlet/Inlet Header Collecting Tube 26

The outlet/inlet header collecting tube 26 is a cylindrical member extending in the vertical direction and fabricated from aluminum or aluminum alloy. The portions of the outdoor heat exchanger 20 where the refrigerant enters and exits are set apart to the top and bottom. The lower portion of the outlet/inlet header collecting tube 26 is connected to the liquid refrigerant pipeline 32 via the distributor 22 as described above. The upper portion of the outlet/inlet header collecting tube 26 is connected to the gas refrigerant pipeline 31. The outlet/inlet header collecting tube 26 is formed in a substantially cylindrical shape, the internal space of the upper portion and the internal space of the lower portion being vertically partitioned by a baffle provided in the interior. The lower portion of the outlet/inlet header collecting tube 26 is vertically partitioned by a plurality of baffles so that the distribution of the refrigerant diverted by the distributor 22 is maintained. Specifically, a configuration is adopted such that each of the refrigerant flows set apart to the top and bottom by the distributor 22 are caused to flow to the heat exchange part 21 while remaining set apart.

According to the above configuration, in cases where the outdoor heat exchanger 20 functions as an evaporator for the refrigerant, the refrigerant having flowed into the heat exchange part 21 via the liquid refrigerant pipeline 32, the distributor 22, and the lower portion of the outlet/inlet header collecting tube 26 and evaporated flows to the exterior via the upper portion of the outlet/inlet header collecting tube 26 and the gas refrigerant pipeline 31. In cases where the outdoor heat exchanger 20 functions as a radiator for the refrigerant, the refrigerant flows in the direction opposite that described above.

(4-5) Connecting Header 23

The connecting header 23 is provided to the heat exchange part 21 on the opposite side from the end where the outlet/inlet header collecting tube 26 and the folding-back header 24 are provided, and is configured so as to guide refrigerant having flowed through the flat perforated tubes 21*b* of the upstream-side heat exchange part 211 into the flat perforated tubes 21*b* of the downstream-side heat exchange part 212 at the same height position, or to guide refrigerant having flowed through the flat perforated tubes 21*b* of the downstream-side heat exchange part 212 into the flat perforated tubes 21*b* of the upstream-side heat exchange part 211 at the same height position. This connecting header 23 fulfills the role whereby flow paths of the refrigerant within the outdoor heat exchanger 20 are merely linked up at the same height position, without any vertical movement of the refrigerant being produced.

(4-6) Folding-Back Header 24

The folding-back header 24 is provided to the end of the heat exchange part 21 opposite the end where the connecting header 23 is provided, so as to extend in the vertical direction further downstream than the outlet/inlet header collecting tube 26. This folding-back header 24 is connected to the end of the heat exchange part 21 opposite the connecting header 23 of the downstream-side heat exchange part 212. The folding-back header 24 is also fabricated from aluminum or aluminum alloy.

Figure 6:
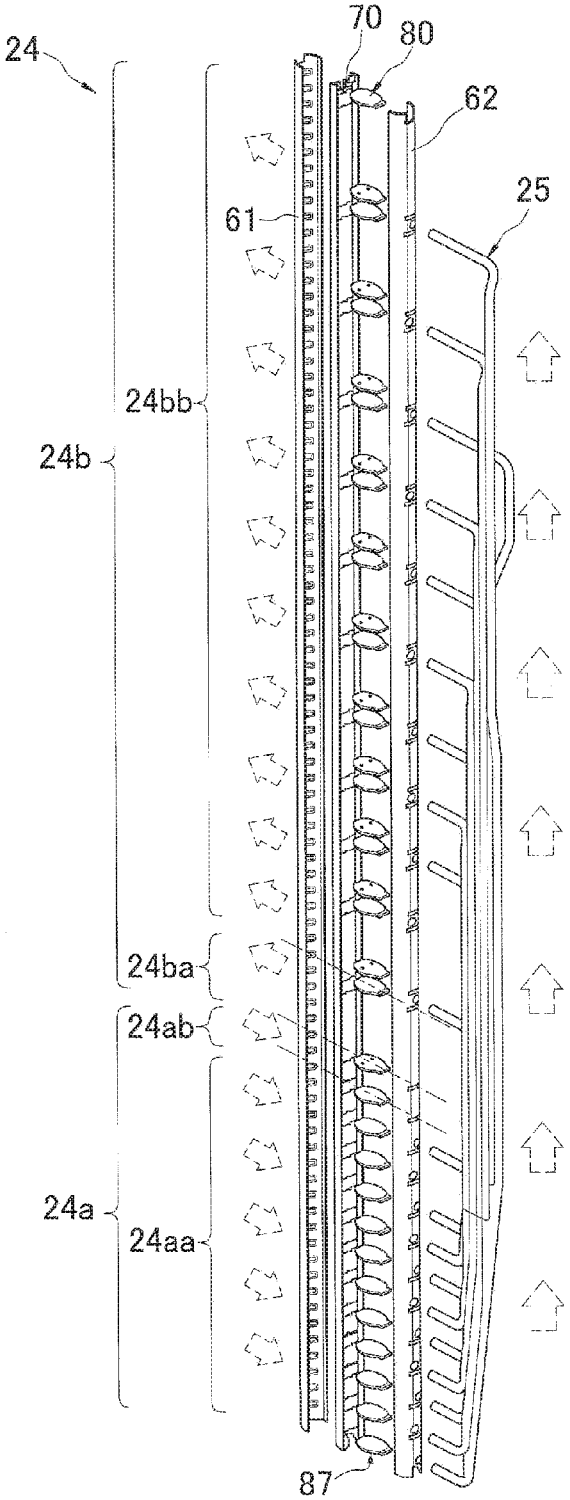
FIG. 6 is an enlarged exploded schematic perspective view of a folding-back header and an interconnecting part.
Figure 7:
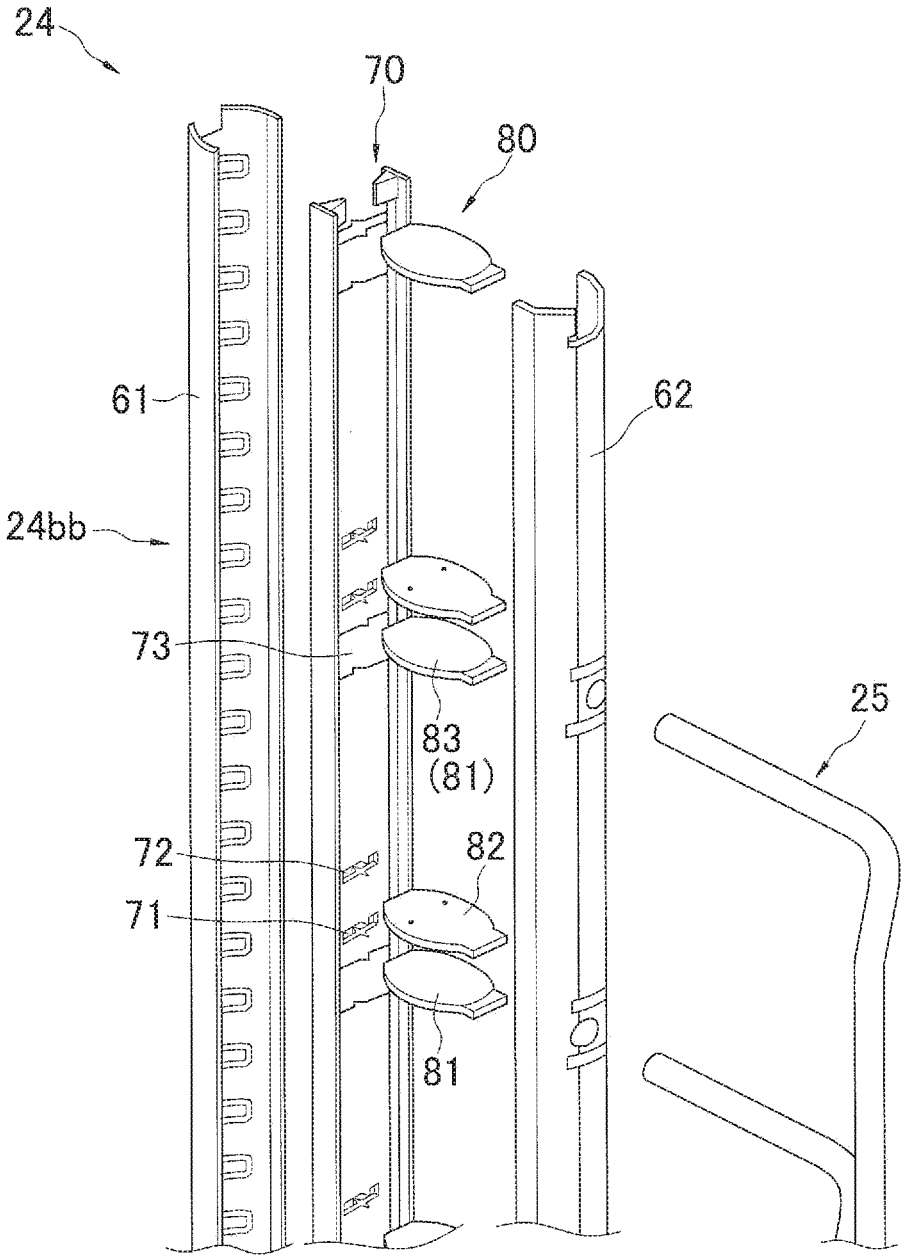
FIG. 7 is an expanded partial schematic perspective view of the folding-back header and the interconnecting part.

As shown in the exploded schematic perspective view of the folding-back header 24 and the interconnecting part 25 in FIG. 6, as well as in the enlarged exploded partial schematic perspective view of the folding-back header 24 and the interconnecting part 25 in FIG. 7, the folding-back header 24 has a perforated-side member 61 to which first ends of the plurality of flat perforated tubes 21*b* are connected, a pipeline-side member 62 constituting the side opposite the side to which the flat perforated tubes 21*b* are connected, a partition member 70 positioned between the perforated-side member 61 and the pipeline-side member 62, and a plurality of baffles 80 for vertically partitioning the space within the folding-back header 24.

The perforated-side member 61 constitutes a wall surface at the heat exchange part 21 side of the folding-back header 24, and is formed in a substantially semicircular-arcuate shape as viewed from above. This perforated-side member 61 has a shape such that the semicircular-arc shape extends in the vertical direction, and is provided, at each height position, with openings that pass through in the plate-thickness direction and are used for the insertion of the flat perforated tubes 21*b*.

The pipeline-side member 62 constitutes a wall surface at the side of the folding-back header 24 opposite the heat exchange part 21, and is formed in a substantially semicircular-arcuate shape as viewed from above. This pipeline-side member 62 has a shape such that the semicircular-arc shape extends in the vertical direction, and is provided, at each height position, with openings that pass through in the plate-thickness direction and are used for the insertion of the interconnecting pipelines of the interconnecting part 25 (described later). This pipeline-side member 62 is also provided, at each height position, with openings for fastening first ends of the baffles 80.

Figure 8:
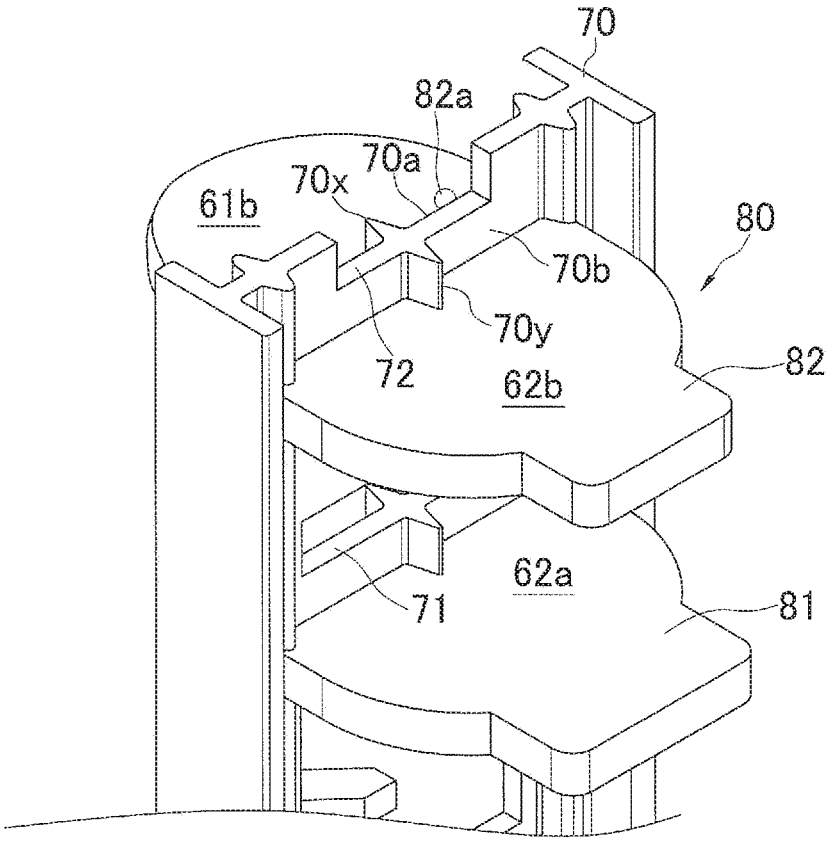
FIG. 8 is a schematic perspective view in which a baffle and a partition member are combined in a state in which the partition member is cut off at a lower communication port.
Figure 9:
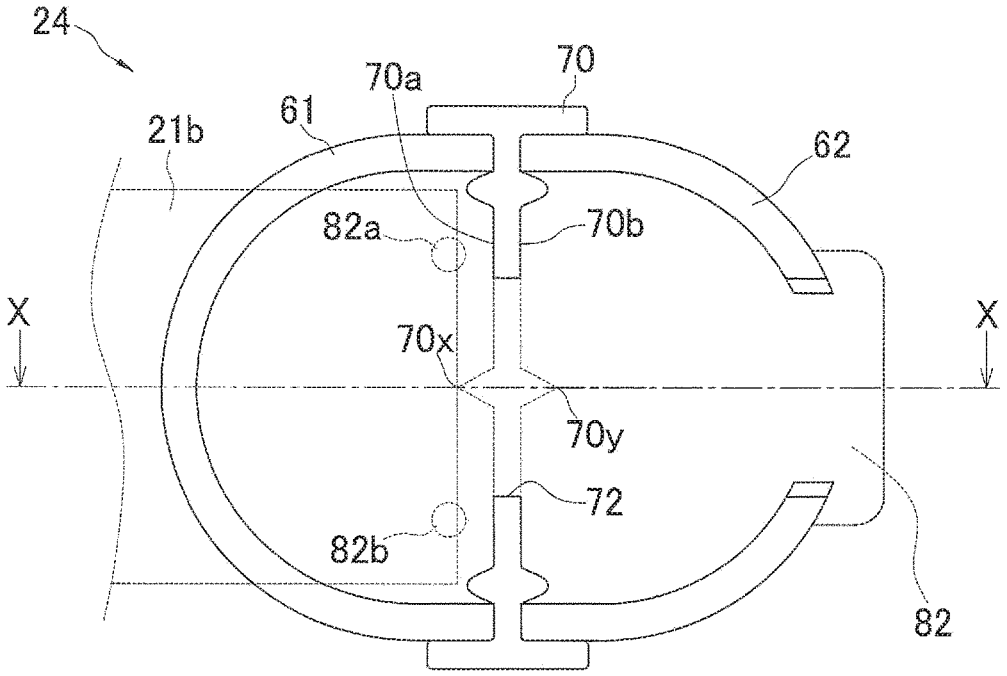
FIG. 9 is a top view in which a rectifier plate, a perforated-side member, a pipeline-side member, and a partition member are combined.

The partition member 70 extends vertically so as to partition the space within the folding-back header 24 in the horizontal direction to form a perforated-side member 61-side space and a pipeline-side member 62-side space. The partition member 70 is provided with openings, at each height position, for inserting and fastening the baffles 80. FIG. 8 is a schematic perspective view in which the baffle 80 and the partition member 70 are combined in a state in which the partition member 70 is cut off in the horizontal direction in the vicinity of a lower communication port 72. FIG. 9 is a top view in which a rectifier plate 82 from among the baffles 80, the perforated-side member 61, the pipeline-side member 62, and the partition member 70 are combined. As shown in FIG. 8 and FIG. 9, the partition member 70 has a perforated-side surface 70*a* which is perforated-side member 61-side surface, and a pipeline-side surface 70*b* which is a pipeline-side member 62-side surface. A perforated-side protrusion 70*x* that bulges toward the perforated-side member 61 is formed near the center of the perforated-side surface 70*a*, the perforated-side protrusion 70*x* extending in the vertical direction in portions other than the opening portion. A pipeline-side protrusion 70*y* that bulges toward the pipeline-side member 62 is formed near the center of the pipeline-side surface 70*b*, the pipeline-side protrusion 70*y* extending in the vertical direction in portions other than the opening portion. The perforated-side member 61 side and pipeline-side member 62 side of the partition member 70 are thus configured in a symmetric form as viewed from above, and therefore no errors occur in the orientation of these members during manufacturing.

As shown in FIG. 6 and FIG. 7, the folding-back header 24 has a lower folding-back portion 24*a* and an upper folding-back portion 24*b*, internal spaces thereof being divided vertically. The internal space of the lower folding-back portion 24*a* is furthermore divided vertically to form a first lower folding-back portion 24*aa* in the lower part and a second lower folding-back portion 24*ab* in the upper part. The internal space of the upper folding-back portion 24*b* is also furthermore divided vertically to form a first upper folding-back portion 24*ba* in the lower part and a second upper folding-back portion 24*bb* in the upper part. In cases where the outdoor heat exchanger 20 functions as an evaporator for the refrigerant, the refrigerant having flowed into the first lower folding-back portion 24*aa* from the heat exchange part 21 is fed to the second upper folding-back portion 24*bb* via an interconnecting pipeline of the interconnecting part 25 (described later), the refrigerant having flowed into the second lower folding-back portion 24*ab* from the heat exchange part 21 is fed to the first upper folding-back portion 24*ba* via the space within the folding-back header 24 without being fed through the interconnecting part 25, and the refrigerant having been fed to the second upper folding-back portion 24*bb* or the first upper folding-back portion 24*ba* is again fed to the heat exchange part 21.

A configuration is adopted in which the number of flat perforated tubes 21*b* connected to the second upper folding-back portion 24*bb* of the upper folding-back portion 24*b* is greater than the number of flat perforated tubes 21*b* connected to the first lower folding-back portion 24*aa* of the lower folding-back portion 24*a*. Additionally, a configuration is adopted in which the number of flat perforated tubes 21*b* connected to the first upper folding-back portion 24*ba* of the upper folding-back portion 24*b* is greater than the number of flat perforated tubes 21*b* connected to the second lower folding-back portion 24*ab* of the lower folding-back portion 24*a*. Any increase or decrease in the ratio of gas phase components in the refrigerant flowing through the outdoor heat exchanger 20 is thereby addressed.

A plurality of flow paths are arranged within the first lower folding-back portion 24*aa* of the lower folding-back portion 24*a* so as to be set apart to the top and bottom. In order to maintain the vertical-direction distribution of refrigerant flowing through the heat exchange part 21, the plurality of flow paths in the interior of the first lower folding-back portion 24*aa* are arranged one by one in the vertical direction while being vertically partitioned by a plurality of baffles 80 in which no openings are formed.

The first lower folding-back portion 24*aa* and the second lower folding-back portion 74*ab* of the lower folding-back portion 24*a* are vertically partitioned by baffles 80 in which no openings are formed.

The lower folding-back portion 24*a* and the upper folding-back portion 24*b* (the second lower folding-back portion 24*ab* of the lower folding-back portion 24*a* and the first upper folding-back portion 24*ba* of the upper folding-back portion 24*b*) are vertically partitioned by baffles 80 (rectifier plates 82) in which ascending openings 82*a*, 82*b* that pass through in the plate-thickness direction are formed.

The internal space of the second lower folding-back portion 24*ab* of the lower folding-back portion 24*a* is partitioned by the partition member 70, and includes a first guide space 61*a* on the flat perforated tube 21*b* side and a second guide space 62*a* on the side opposite the flat perforated tube 21*b* side.

The first upper folding-back portion 24*ba* and the second upper folding-back portion 24*bb* of the upper folding-back portion 24*b* are vertically partitioned by the baffles 80 in which no openings are formed.

The internal space of the first upper folding-back portion 24*ba* of the upper folding-back portion 24*b* is partitioned by the partition member 70, and includes an ascending space 61*b* on the flat perforated tube 21*b* side and a descending space 62*b* on the side opposite the flat perforated tube 21*b* side.

Figure 10:
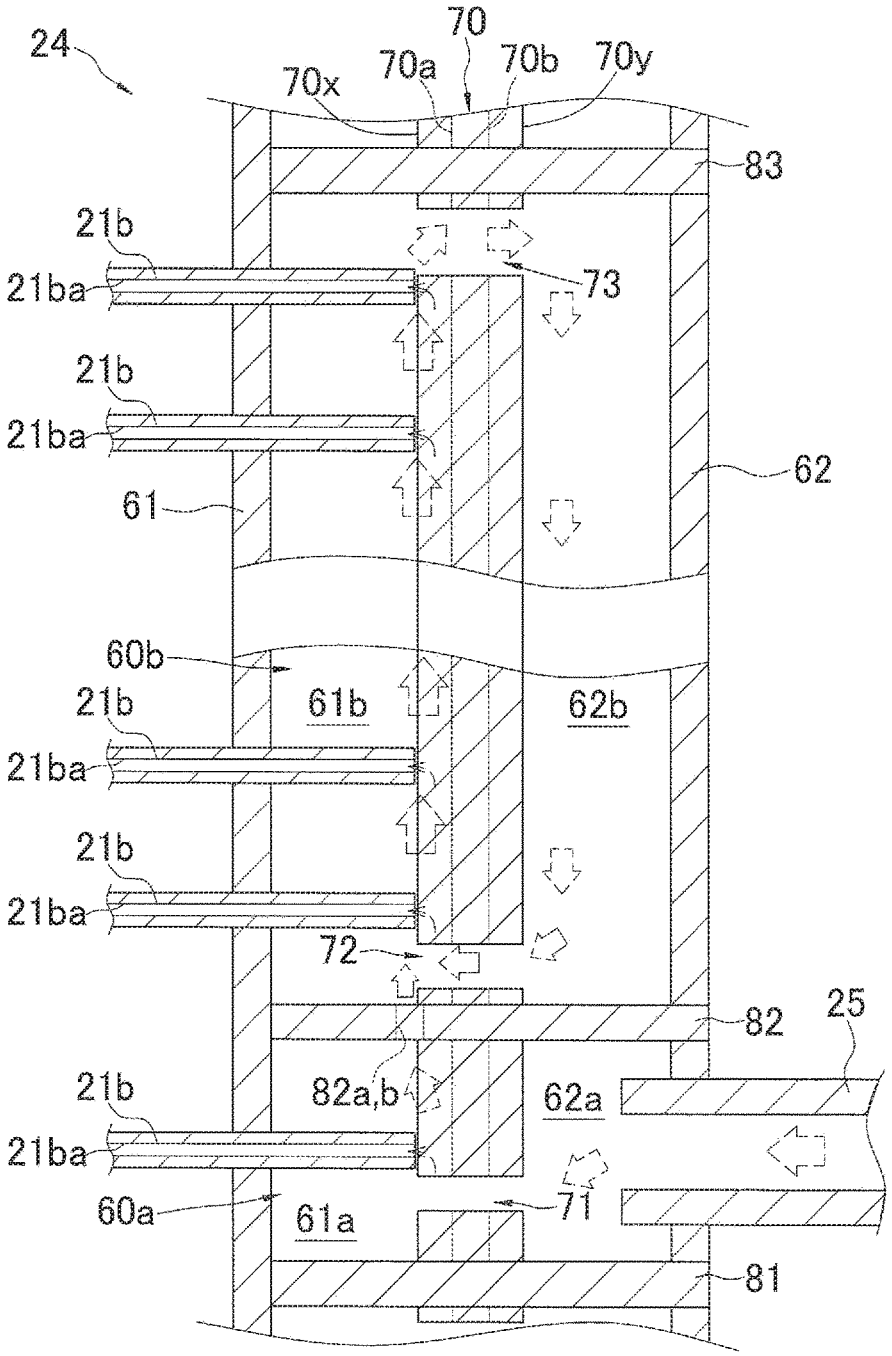
FIG. 10 is a schematic cross-sectional view of a loop structure and a rectifier structure in the folding-back header.

A plurality of flow paths are arranged within the second upper folding-back portion 24*bb* of the upper folding-back portion 24*b* so as to be separated vertically. In order to maintain the vertical-direction distribution of refrigerant flowing through the heat exchange part 21 in each of the flow paths, in the interior of the second upper folding-back portion 24*bb*, the plurality of flow paths are arranged one by one in the vertical direction while being vertically partitioned by the plurality of baffles 80 (lower partition plate 81 and upper partition plate 83 in FIG. 7) in which no openings are formed. As shown in FIG. 10 (described later), one flow path among the plurality of flow paths provided within the second upper folding-back portion 24*bb* is configured so as to include a space (described later) in which the first guide space 61*a*, the second guide space 62*a*, the ascending space 61*b*, and the descending space 62*b* are grouped (a group of spaces). Therefore, the interior of the second upper folding-back portion 24*bb* of the upper folding-back portion 24*b* is configured such that the group of spaces constituting the one flow path is arranged in a plurality side by side in the vertical direction. Each group of spaces constituting the one flow path is sandwiched in the vertical direction by the lower partition plate 81 and the upper partition plate 83. The lower partition plate 81 and the upper partition plate 83 are at times described through differentiation for expedience of description, but both are the baffles 80 having the same shape in which no openings are formed, the relationship between these baffles 80 being that the upper partition plate 83 of the group of spaces is the lower partition plate 81 of the one level higher group of spaces. As shown in FIG. 7, in each of the spaces in the group of spaces within the second upper folding-back portion 24*bb*, the interior is vertically partitioned by the rectifier plate 82 in which the ascending openings 82*a*, 82*b* are formed.

The rectifier plate 82 is provided with a plurality of ascending openings 82*a*, 82*b* (first ascending opening 82*a* and second ascending opening 82*b*), as shown in FIG. 9, which is a top view of a state in which the rectifier plate 82, the perforated-side member 61, the pipeline-side member 62, and the partition member 70 are combined. Centers of these openings are arranged side by side in a direction perpendicular to a longitudinal direction of the flat perforated tubes 21*b* as viewed from above. The first ascending opening 82*a* and the second ascending opening 82*b* are arranged so as to have line symmetry with respect to a line obtained by extending a widthwise center portion of the flat perforated tubes 21*b* along the longitudinal direction of the flat perforated tubes 21*b* as viewed from above, the widthwise center portion being disposed in the direction perpendicular to the longitudinal direction of the flat perforated tubes 21*b*. The distance between the centers of the plurality of ascending openings 82*a*, 82*b* is arranged so as to be longer than the opening of the lower communication port 72 (greater than the opening width in a direction perpendicular to the longitudinal direction of the flat perforated tubes 21*b* as viewed from above) formed in the partition member 70 and less than the horizontal-direction width of the flat perforated tubes 21*b*, and so as to be set apart from the lower communication port 72. The horizontal-direction opening width of the lower communication port 72 is at least 30% of the horizontal-direction width of the flat perforated tubes 21*b*. Both of the ascending openings 82*a*, 82*b* of the rectifier plate 82 are positioned so as to have areas of overlap with the flat perforated tubes 21*b* as viewed from above. In the present embodiment, a portion constituting 70-90% of the ascending openings 82*a*, 82*b* overlaps with the flat perforated tubes 21*b* as viewed from above. A region obtained by extending the inner edge of the lower communication port 72 formed in the partition member 70 so as to follow the longitudinal direction of the flat perforated tubes 21*b* is arranged so as not to overlap with either of the ascending openings 82*a*, 82*b* of the rectifier plate 82 as viewed from above. The ascending openings 82*a*, 82*b* provided to the rectifier plate 82 are provided so as to be set apart from the join portion of the partition member 70 and the rectifier plate 82 as viewed from above. Therefore, even in cases in a brazing operation is performed during manufacture, the brazing material is not likely to reach the position of the ascending openings 82*a*, 82*b*, and it is possible to minimize obstruction of the ascending openings 82*a*, 82*b*. Half or more of the area of the ascending space 61*b* is covered by the flat perforated tubes 21*b* as viewed from above.

The position and size of the lower communication port 72, as well as the positional relationship between the lower communication port 72 and the closest flat perforated tube 21*b*, are described with reference to FIG. 10, which is a front view in which the second upper folding-back portion 24*bb* of the upper folding-back portion 24*b* of the folding-back header 24 is cut off at the cross-section X-X shown in FIG. 9. The lower communication port 72 is disposed so as to be set apart above the upper surface of the rectifier plate 82 by a predetermined distance. An inflow port 21*ba* of the closest flat perforated tube 21*b* (lowest-stage flat tube) disposed above the rectifier plate 82 is disposed higher above the upper end of the lower communication port 72. Therefore, the lower communication port 72 and the inflow port 21*ba* of the flat perforated tube 21*b* (lowest-stage flat tube) closest to the rectifier plate 82 are not present at the same height.

Both the lower partition plate 81 and the upper partition plate 83 constitute the baffle 80, both having the same shape and dimensions, and both having no openings formed therein; for expedience of description, the baffle 80 that constitutes the lower end of the group of spaces is described as the lower partition plate 81, and the baffle 80 that constitutes the upper end of the group of spaces is described as the upper partition plate 83. The upper partition plate 83 of a given group of spaces also functions as the lower partition plate 81 of the next higher group of spaces.

As shown in FIG. 10, the second upper folding-back portion 24*bb* of the upper folding-back portion 24*b* of the folding-back header 24 is provided with a first guide space 61*a* and a second guide space 62*a* as spaces (guide part 60*a*) vertically bounded by the lower partition plate 81 and the rectifier plate 82 in which the ascending openings 82*a*, 82*b* are formed. The first guide space 61*a* and the second guide space 62*a* are partitioned by the partition member 70, the first guide space 61*a* being positioned on side of the partition member 70 facing the flat perforated tubes 21*b*, and the second guide space 62*a* being positioned on the side of the partition member 70 facing the opposite the flat perforated tubes 21*b* side. The portion of the partition member 70 positioned between the first guide space 61*a* and the second guide space 62*a* has formed therein a guide communication port 71 for enabling refrigerant to pass between the first guide space 61*a* and the second guide space 62*a*. As described above, the plurality of flow paths in the second upper folding-back portion 24*bb* of the upper folding-back portion 24*b* are connected, in a one-to-one relationship, to the first lower folding-back portion 24*aa* of the lower folding-back portion 24*a* via the interconnecting pipeline, etc., of the interconnecting part 25, the interconnecting pipeline of the interconnecting part 25 being connected to the second guide space 62*a*.

The second upper folding-back portion 24*bb* of the upper folding-back portion 24*b* of the folding-back header 24 is also provided with an ascending space 61*b* and a descending space 62*b* as spaces (header part 60*b*) vertically bounded by the upper partition plate 83 and the rectifier plate 82 in which the ascending openings 82*a*, 82*b* are formed. The ascending space 61*b* and the descending space 62*b* are partitioned by the partition member 70, in which the upper communication port 73 and the lower communication port 72 are formed. The upper sections of the ascending space 61*b* and the descending space 62*b* communicate via the upper communication port 73. The lower sections of the ascending space 61*b* and the descending space 62*b* communicate via the lower communication port 72.

The second lower folding-back portion 24*ab* of the lower folding-back portion 24*a* of the folding-back header 24 and the first upper folding-back portion 24*ba* of the upper folding back portion 24*b* of the folding-back header 24 are interconnected not via the interconnecting pipeline, etc., of the interconnecting part 25, but by the interior of the folding-back header 24, and therefore the interconnecting pipeline of the interconnecting part 25 is not connected to the second guide space 62*a* of the first upper folding-back portion 24*ba*. The structures of the first guide space 61*a*, second guide space 62*a*, ascending space 61*b*, and descending space 62*b* and the like are the same as those in the second upper folding-back portion 24*bb* of the upper folding-back portion 24*b*, and therefore no description is given therefor.

(4-7) Interconnecting Part 25

The interconnecting part 25 has a plurality of interconnecting pipelines. Each of the interconnecting pipelines is connected, in a one-to-one relationship, to each of the space vertically divided into a plurality in the first lower folding-back portion 24*aa* of the lower folding-back portion 24*a* of the folding-back header 24, and to each of the space in which the first guide space 61*a*, the second guide space 62*a*, the ascending space 61*b*, and the descending space 62*b* are grouped (the group of spaces), the group of spaces being arranged in a plurality of sets side by side in the vertical direction in the second upper folding-back portion 24*bb* of the upper folding-back portion 24*b* of the folding-back header 24.

The interconnecting pipelines are provided such that the lower-positioned space in the first lower folding-back portion 24*aa* of the lower folding-back portion 24*a* is connected to the higher-positioned group of spaces in the second upper folding-back portion 24*bb* of the upper folding-back portion 24*b*.

In cases where the outdoor heat exchanger 20 functions as an evaporator for the refrigerant, the refrigerant flowing through the lower portion of the downstream-side heat exchange part 212 of the heat exchange part 21 first flows into each of the spaces in the lower folding-back portion 24*a* with the diverged state maintained, as shown by arrows in FIG. 6. The refrigerant having flowed into each of the spaces in the first lower folding-back portion 24*aa* of the lower folding-back portion 24*a* is fed, via the interconnecting pipelines of the interconnecting part 25 provided in a one-to-one relationship, to the group of spaces of the second upper folding-back portion 24*bb* of the corresponding upper folding-back portion 24*b*. The refrigerant having been fed to the group of spaces in the second upper folding-back portion 24*bb* of the upper folding-back portion 24*b* flows to the upper portion of the downstream-side heat exchange part 212 of the heat exchange part 21 with the diverged state maintained. In cases where the outdoor heat exchanger 20 functions as a radiator for the refrigerant, the refrigerant flows in the direction opposite that described above, excluding the ascending space 61*b* and the descending space 62*b*.

However, the second lower folding-back portion 24*ab*, which is the uppermost of the plurality of spaces within the lower folding-back portion 24*a*, and the first upper folding-back portion 24*ba*, which is the lowermost of the plurality of spaces within the upper folding-back portion 24*b*, are not connected by the interconnecting pipelines of the interconnecting part 25. As shown in FIG. 6, these spaces are partitioned by the rectifier plate 82 as a baffle 80 in which an ascending opening that passes through in the vertical direction is provided. Ascending openings 82*a*, 82*b* that pass through in the plate-thickness direction are formed in the rectifier plate 82. Therefore, the refrigerant in the second lower folding-back portion 24*ab* does not exit from within the folding-back header 24 to the outside, but rather is fed from the second lower folding-back portion 24*ab* to the first upper folding-back portion 24*ba* via the ascending openings 82*a*, 82*b* of the rectifier plate 82 (similarly for flow in the opposite direction as well).

The folding-back header 24 thus properly constitutes a folding-back portion in the flow paths for refrigerant in the outdoor heat exchanger 20.

In cases where the outdoor heat exchanger 20 functions as an evaporator for the refrigerant, the refrigerant having flowed out from the folding-back header 24 to the upper portion of the downstream-side heat exchange part 212 flows through the upper portion of the downstream-side heat exchange part 212 to the connecting header 23 at the other end with the diverged state maintained, moves in the connecting header 23 toward the upstream-side heat exchange part 211, and flows through the upper portion of the upstream-side heat exchange part 211 toward the upper portion of the outlet/inlet header collecting tube 26 of the upstream-side heat exchange part 211 with the diverged state maintained, as shown by arrows in FIG. 6. The refrigerant having flowed into the upper portion of the outlet/inlet header collecting tube 26 converges, then flows via the gas refrigerant piping 31 to the intake side of the compressor 91.

(5) Loop Structure of Folding-Back Header 24

The loop structure is described below with reference to FIG. 10, particular attention being paid to the space in which the first guide space 61*a*, the second guide space 62*a*, the ascending space 61*b*, and the descending space 62*b* within the second upper folding-back portion 24*bb* of the folding-back header 24 are grouped (a group of spaces). The group of spaces is arranged in a plurality side by side in the vertical direction within the second upper folding-back portion 24*bb* of the folding-back header 24; because the structure is the same in other portions, no description is given.

The rectifier plate 82 is a plate-shaped member in which the group of spaces described above, within the folding-back header 24, are vertically partitioned into the first guide space 61*a* and second guide space 62*a*, located below, and the ascending space 61*b* and descending space 62*b*, located above.

The partition member 70 partitions the first guide space 61*a* and second guide space 62*a* into a perforated-side member 61-side first guide space 61*a* and a pipeline-side member 62-side second guide space 62*a*. The partition member 70 also partitions the ascending space 61*b* and descending space 62*b* into a perforated-side member 61-side ascending space 61*b* and a pipeline-side member 62-side descending space 62*b*.

The guide communication port 71, upper communication port 73, and lower communication port 72 provided to the partition member 70 all extend in the horizontal direction.

The interconnecting pipelines of the interconnecting part 25 are connected to the second guide space 62*a*.

The rectifier plate 82 is disposed such that the vertical-direction distance between the rectifier plate 82 and the flat perforated tube 21*b* (the lowest-stage flat tube) positioned closest to the top of the rectifier plate 82 is less than a predetermined interval between flat perforated tubes 21*b* arranged side by side in the vertical direction.

The ascending space 61*b*-side outlet of the lower communication port 72 is positioned further downward than is the flat perforated tube 21*b* that is positioned lowest (the lowest-stage flat tube) among the flat perforated tubes 21*b* that are connected to the ascending space 61*b*.

The rectifier plate 82 is provided with the ascending openings 82*a*, 82*b*, which are openings that extend in the vertical direction so that the first guide space 61*a* and the ascending space 61*b* communicate. The refrigerant having been directed from the first guide space 61*a* to the higher ascending space 61*b* passes through the ascending openings 82*a*, 82*b* provided in the manner of nozzles for narrowing the flow paths of the rectifier plate 82, therefore making it possible to sufficiently narrow down the refrigerant flow and increase the flow rate of refrigerant flowing in the vertically upward direction.

The ascending space 61*b* is partitioned from the descending space 62*b* by the partition member 70, thereby making it possible to reduce the passage area when the refrigerant ascends in the ascending space 61*b* to less than the total horizontal area of the ascending space 61*b* and the descending space 62*b*. Therefore, the ascent velocity of the refrigerant having flowed into the ascending space 61*b* via the ascending openings 82*a*, 82*b* is easily maintained, making it easy to allow the refrigerant to reach the top portion within the ascending space 61*b* even when the circulation rate is low.

The area obtained by subtracting "the horizontal area of the portions of the flat perforated tubes 21*b* that protrude into the ascending space 61*b*" from "the horizontal area of the ascending space 61*b* at a height position at which no flat perforated tubes 21*b* are present" (i.e., the area of a portion of the ascending space 61*b* in which the refrigerant ascends avoiding the flat perforated tubes 21*b*) is disposed so as to be greater than the refrigerant passage area of the lower communication port 72. Consequently, the refrigerant having flowed into the ascending space 61*b* via the ascending openings 82*a*, 82*b* of the rectifier plate 82 does not form a reverse current toward the descending space 62*b* via the lower communication port 72, which is narrower and more difficult to pass through, but rather flows through a portion of the ascending space 61*b* that excludes the flat perforated tubes 21*b*, this portion being wider and easier to pass through. Moreover, as described above, the ascending openings 82*a*, 82*b* of the rectifier plate 82 are disposed so as not to overlap the lower communication port 72 (so as not to overlap a region obtained by extending the lower communication port 72 along the longitudinal direction of the flat perforated tubes 21*b*); therefore, reverse current of the refrigerant toward the descending space 62*b* via the lower communication port 72 can be more effectively minimized.

The ascending openings 82*a*, 82*b* provided to the rectifier plate 82 and the flat perforated tube 21*b* (the lowest-stage flat tube) positioned above the ascending openings 82*a*, 82*b* so as to be closest to and directly above the ascending openings 82*a*, 82*b* are disposed so as to have an area of overlap as viewed from above. The area of this area of overlap is disposed so as to be greater than the area of non-overlap of the ascending openings 82*a*, 82*b* and the flat perforated tube 21*b* directly above the ascending openings 82*a*, 82*b* as viewed from above. In the present embodiment, at least 70% of the ascending openings 82*a*, 82*b* is provided so as to overlap the flat perforated tube 21*b* (the lowest-stage flat tube) as viewed from above, but no limitation is provided thereby.

A loop structure is employed in the partition member 70 through the formation of the upper communication port 73 and the lower communication port 72. Therefore, the refrigerant having reached the upper part of the ascending space 61*b* without flowing into the flat perforated tubes 21*b* is guided into the descending space 62*b* via the upper communication port 73, descending by gravity in the descending space 62*b*, and returning to the lower part of the ascending space 61*b* via the lower communication port 72, as shown by arrows in FIG. 10. The refrigerant having reached the upper part of the ascending space 61*b* thus can return to the lower part of the ascending space 61*b* again and form a loop.

(6) Manner in which Refrigerant in Outdoor Heat Exchanger 20 Flows in a Case of a Low Circulation Rate During Heating Operation The manner in which flow of the refrigerant in the outdoor heat exchanger 20 in a case of a low circulation rate during heating operation shall now be described.

Refrigerant having flowed into the ascending space 61*b* from the first guide space 61*a* via the interconnecting part 25, the second guide space 62*a*, and the guide communication port 71 is in a state in which a gas phase component and a liquid phase component having different specific gravities are mixed.

In a case of a low circulation rate, the per-unit-time amount of refrigerant flowing into the ascending space 61*b* will be low, and the flow rate of the refrigerant will be relatively low. Therefore, if the flow rate remains unchanged, the high-specific-gravity liquid phase component of the refrigerant is not likely to rise, making it difficult for the refrigerant to reach the flat perforated tubes 21*b* positioned higher among the plurality of flat perforated tubes 21*b* in the ascending space 61*b*, causing the amount passing through the plurality of flat perforated tubes 21*b* in the ascending space 61*b* to become non-uniform in accordance with height position, and presenting a risk that unevenly distributed flow will be generated. When primarily the gas phase component having a low specific gravity in the refrigerant flows into a first end of the flat perforated tubes 21*b* arranged comparatively higher in this manner, the degree of superheat of the refrigerant flowing out from the other end of the flat perforated tubes 21*b* becomes too high, failing to produce a phase change while the refrigerant passes through the flat perforated tubes 21*b* and producing portions in which sufficient heat exchange capability cannot be exhibited. On the other hand, when primarily the liquid phase component having a high specific gravity in the refrigerant flows into the first end of the flat perforated tubes 21*b* arranged comparatively lower, the degree of superheat of the refrigerant flowing out from the other end of the flat perforated tubes 21*b* does not readily rise, allowing the refrigerant to reach the other end of the flat perforated tubes 21*b* without evaporating in some cases, and thus producing portions in which sufficient heat exchange capability cannot be exhibited.

However, in cases where the outdoor heat exchanger 20 of the present embodiment is used in a state in which the circulation rate is low, the flow of refrigerant in the ascending openings 82*a*, 82*b* of the rectifier plate 82 is narrowed and the passage area of the ascending space 61*b* is kept small due to being partitioned by the partition member 70, whereby the liquid phase component having a high specific gravity in the refrigerant supplied to the ascending space 61*b* is guided higher than in the prior art, making it possible to ameliorate unevenly distributed flows even when the circulation rate is low.

This makes it possible, in the outdoor heat exchanger 20 of the present embodiment, to keep the state of the refrigerant flowing into the plurality of flat perforated tubes 21*b* disposed in portions at differing height positions in the ascending space 61*b* as uniform as possible even when the circulation rate is low.

(7) Manner in which Refrigerant in Outdoor Heat Exchanger 20 Flows in a Case of a High Circulation Rate During Heating Operation The manner in which the refrigerant in the outdoor heat exchanger 20 flows in a case of a high circulation rate during heating operation shall now be described.

Refrigerant having flowed into the ascending space 61*b* from the first guide space 61*a* via the interconnecting part 25, the second guide space 62*a*, and the guide communication port 71 is in a state in which a gas phase component and a liquid phase component having different specific gravities are mixed, in the same manner as in a case of a low circulation rate.

In a case of a high circulation rate, the per-unit-time amount of refrigerant flowing into the ascending space 61*b* will be high, and the flow rate of the refrigerant will be relatively high. Moreover, a throttle function of the ascending opening 82*a*, 82*b* is employed as a measure against the low circulation rate described above, whereby the flow rate further increases. Furthermore, the refrigerant passage cross-sectional area of the ascending space 61*b* is reduced by the partition member 70 as a measure against the low circulation rate described above, and therefore the ascent velocity of the refrigerant is not likely to decline. Consequently, in a case of a high circulation rate, the liquid phase component having a high specific gravity in the refrigerant violently passing through the ascending openings 82*a*, 82*b* passes through the ascending space 61*b* without flowing into the flat perforated tubes 21*b* and tends to collect in the upper side. In this case, the liquid phase component having a high specific gravity readily collects in the upper side and the gas phase component having a low specific gravity readily collects in the lower side. The distribution will be different from that in a case of a low circulation rate, but an unevenly distributed flow will still occur.

By contrast, in the outdoor heat exchanger 20 of the present embodiment, a loop structure is employed by providing the upper communication port 73 to the upper portion of the partition member 70 and providing the lower communication port 72 to the lower portion of the partition member 70. Therefore, even when a large amount of the liquid phase component of the refrigerant reaches the upper end of the ascending space 61*b*, the refrigerant can be guided to the descending space 62*b* via the upper communication port 73, caused to descend by gravity in the descending space 62*b*, and then returned to the lower side of the ascending space 61*b* again via the lower communication port 72.

The refrigerant having been returned to the ascending space 61*b* via the lower communication port 72 can be drawn into the ascending flow of the refrigerant passing through the ascending openings 82*a*, 82*b*, and again caused to ascend into the ascending space 61*b* and flow into the flat perforated tubes 21*b* (the refrigerant may be made to form a loop multiple times).

This makes it possible, in the outdoor heat exchanger 20 of the present embodiment, for the state of the refrigerant flowing into the plurality of flat perforated tubes 21*b* disposed in portions at differing height positions of the ascending space 61*b* to be kept as uniform as possible even when the circulation rate is high.

(8) Characteristics of Outdoor Heat Exchanger 20 of Air Conditioning Apparatus 1

(8-1)

The outdoor heat exchanger 20 of the present embodiment makes it possible, in a case of a high circulation rate, to return the refrigerant having formed a loop via the upper communication port 73, the descending space 62*b*, and the lower communication port 72 to the ascending space 61*b* again and guide the refrigerant to the flat perforated tubes 21*b*, even when the liquid phase component of the refrigerant reaches the upper side within the ascending space 61*b*.

Even in a case of a low circulation rate, the rate at which the refrigerant flows is increased when the refrigerant passes through the ascending openings 82*a*, 82*b* formed in the rectifier plate 82, and the ascending space 61*b* is narrowed by being partitioned by the partition member 70. Therefore, the outdoor heat exchanger 20 of the present embodiment makes it possible to minimize any decline in the ascent velocity of the refrigerant and facilitate causing the refrigerant to reach the upper side within the ascending space 61*b*.

According to the above, the outdoor heat exchanger 20 of the present embodiment makes it possible for the unevenly distributed flow of the refrigerant flowing to the plurality of flat perforated tubes 21*b* disposed so as to be arranged side by side in the vertical direction to be kept to a minimum irrespective of whether low circulation rates, high circulation rates, or both occur.

(8-2)

In the outdoor heat exchanger 20 of the present embodiment, the ascending openings 82*a*, 82*b* formed in the rectifier plate 82 and the lower communication port 72 used when forming the refrigerant into a loop as described above are disposed such that a region obtained by extending the lower communication port 72 along the longitudinal direction of the flat perforated tubes 21*b* as viewed from above and the ascending openings 82*a*, 82*b* do not overlap as viewed from above. Therefore, the refrigerant having passed through the ascending openings 82*a*, 82*b* of the rectifier plate 82 and flowed into the ascending space 61*b* is not readily guided into the lower communication port 72 even when colliding with the lower surface of the closest flat perforated tube 21*b* (lowest-stage flat tube). Therefore, it is possible to minimize reverse current of the refrigerant flowing from the ascending space 61*b* to the descending space 62*b* via the lower communication port 72.

The lower communication port 72 and the inflow port 21*ba* of the flat perforated tube 21*b* (lowest-stage flat tube) closest to the rectifier plate 82 are not present at the same height, therefore making it possible to minimize the chance that the refrigerant having been formed into a loop via the lower communication port 72 will flow in a concentrated manner to a specific flat perforated tube 21*b*.

The lower end of the lower communication port 72 is positioned further downward than is the lower end of the flat perforated tube 21*b* (lowest-stage flat tube) closest to the rectifier plate 82. In particular, in the embodiment described above, the lower surface of the flat perforated tube 21*b* (lowest-stage flat tube) closest to the rectifier plate 82 is disposed at a position higher than the upper end of the lower communication port 72. Therefore, when the refrigerant having ascended in the ascending space 61*b* has collided with the lower surface of the flat perforated tube 21*b* (lowest-stage flat tube) closest to the rectifier plate 82, the refrigerant will already have passed above the lower communication port 72 in the height direction. Accordingly, even when the refrigerant flow is disrupted after the collision, the refrigerant is not likely to form a reverse current toward the descending space 62*b* via the lower communication port 72.

(8-3)

In the outdoor heat exchanger 20 of the present embodiment, the plurality of ascending openings 82*a*, 82*b* of the rectifier plate 82 are symmetrically arranged side by side in the width direction with respect to the flat perforated tubes 21*b*; therefore, the refrigerant having been directed from the plurality of ascending openings 82*a*, 82*b* to the flat perforated tubes 21*b* can be equalized in the width direction of the flat perforated tubes 21*b* without collecting in the center portion. As shown in FIG. 9, the plurality of ascending openings 82*a*, 82*b* of the rectifier plate 82 and the lower communication port 72 of the partition member 70 are arranged side by side in the width direction of the flat perforated tubes 21*b*. Therefore, unevenly distributed flow in the width direction of the flat perforated tubes 21*b* can be minimized.

(9) Additional Embodiments

The preceding embodiment has been described as but one example of embodiment of the present invention, but is in no way intended to limit the invention of the present application, which is not limited to the afore described embodiment. The scope of the invention of the present application would as a matter of course include appropriate modifications that do not depart from the spirit thereof.

(9-1) Additional Embodiment: A

The above embodiment describes, by way of example, a case in which only one lower communication port 72 for returning refrigerant from one descending space 62*b* to one ascending space 61*b* is formed.

Figure 11:
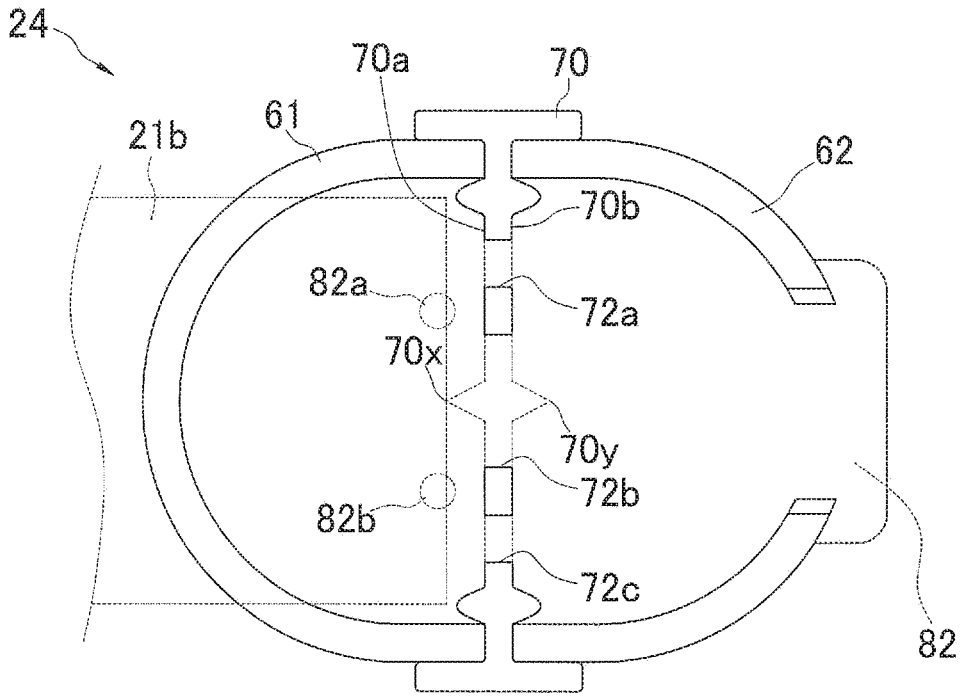
FIG. 11 is a top view in which a rectifier plate, a perforated-side member, a pipeline-side member, and a partition member are combined according to another embodiment A.

However, the present invention is not limited to this configuration; for example, as shown in FIG. 11, the partition member 70 may be provided with a plurality of lower communication ports, such as a first lower communication port 72*a*, second lower communication port 72*b*, and third lower communication port 72*c*, as openings that correspond to the lower communication port 72 of the afore described embodiment. In this case as well, a region obtained by extending each of the first lower communication port 72*a*, the second lower communication port 72*b*, and the third lower communication port 72*c* along the longitudinal direction of the flat perforated tubes 21*b* as viewed from above and the ascending openings 82*a*, 82*b* provided to the rectifier plate 82 do not overlap as viewed from above. The same effect can be achieved in this case as in the afore described embodiment.

(9-2) Additional Embodiment B

In the embodiment described above and the additional embodiment A described above, a configuration in which a region obtained by extending the lower communication port 72, etc., along the longitudinal direction of the flat perforated tubes 21*b* as viewed from above and the ascending openings 82*a*, 82*b* provided to the rectifier plate 82 do not overlap at all as viewed from above was described as an example.

However, the present invention is not limited to this configuration; for example, the area of overlap, as viewed from above, between the ascending openings 82*a*, 82*b* provided to the rectifier plate 82 and a region obtained by extending the lower communication port 72, etc., along the longitudinal direction of the flat perforated tubes 21*b* may be up to 50% of the area of the ascending openings 82*a*, 82*b* as viewed from above. Although the effect achieved in this case is diminished in comparison with a case in which there is no overlap at all, a sufficient effect can be achieved to a greater extent than in a case of complete overlap.

What is claimed is:

1. A heat exchanger, comprising:

a plurality of flat tubes arranged mutually side by side;

a header part extending upward along a first direction in which the plurality of flat tubes are arranged side by side, an interior of the header part being partitioned into a first space and a second space, and one end of each of the plurality of flat tubes being connected to the first space; and a guide part having a guide space positioned below the first space, the guide space communicating with the first space via a vertical opening, the first space and the second space communicating with each other via an upper communication port provided within an upper side of the header part and a lower communication port provided within a lower side of the header part, when the heat exchanger is viewed from above in the first direction, the plurality of flat tubes and the vertical opening have an area of overlap, when the heat exchanger is viewed from above in the first direction, the vertical opening and a region where the lower communication port is extended along a second direction in which the plurality of flat tubes extend do not overlap, or the vertical opening and the region where the lower communication port is extended along the second direction in which the plurality of flat tubes extend have an area of overlap that is up to 50% of the vertical opening, and a width of the lower communication port in a horizontal direction viewed from the second direction being larger than a width of the vertical opening in the horizontal direction viewed from the second direction.

2. The heat exchanger according to claim 1, wherein at least one of the vertical opening and the lower communication port includes a plurality of ports spaced apart from each other.

3. The heat exchanger according to claim 2, wherein each of the plurality of flat tubes has a plurality of inflow ports arranged side by side in the horizontal direction in ends within the first space, and when the heat exchanger is viewed from above in the first direction, with respect to the space where the lower communication port is extended along the second direction in which the plurality of flat tubes extend, the vertical opening includes a first vertical opening provided at one side relative to the region as one of the plurality of ports and a second vertical opening provided at an other side relative to the region as one of the plurality of ports.

4. The heat exchanger according to claim 3, wherein a lower end of the lower communication port is positioned further downward than a lower end of a lowest-stage flat tube, the lowest-stage flat tube being a flat tube arranged furthest downward above the vertical opening among the plurality of flat tubes connected to the first space.

5. The heat exchanger according to claim 4, wherein the header part has a header partition member partitioning the first space and the second space, a guide partition member partitions the guide space and the first space of the header part, an upper surface of the guide partition member includes a portion in contact with the header partition member, and the vertical opening passes through the guide partition member in a plate-thickness direction at a position spaced from a position of contact between the guide partition member and the header partition member.

6. An air conditioning apparatus including the heat exchanger of claim 5 connected in a refrigerant circuit, the air conditioning apparatus further comprising a variable-capacity compressor connected in the refrigerant circuit.

7. The heat exchanger according to claim 3, wherein the header part has a header partition member partitioning the first space and the second space, a guide partition member partitions the guide space and the first space of the header part, an upper surface of the guide partition member includes a portion in contact with the header partition member, and the vertical opening passes through the guide partition member in a plate-thickness direction at a position spaced from a position of contact between the guide partition member and the header partition member.

8. An air conditioning apparatus including the heat exchanger of claim 3 connected in a refrigerant circuit, the air conditioning apparatus further comprising a variable-capacity compressor connected in the refrigerant circuit.

9. The heat exchanger according to claim 2, wherein a lower end of the lower communication port is positioned further downward than a lower end of a lowest-stage flat tube, the lowest-stage flat tube being a flat tube arranged furthest downward above the vertical opening among the plurality of flat tubes connected to the first space.

10. The heat exchanger according to claim 2, wherein the header part has a header partition member partitioning the first space and the second space, a guide partition member partitions the guide space and the first space of the header part, an upper surface of the guide partition member includes a portion in contact with the header partition member, and the vertical opening passes through the guide partition member in a plate-thickness direction at a position spaced from a position of contact between the guide partition member and the header partition member.

11. An air conditioning apparatus including the heat exchanger of claim 2 connected in a refrigerant circuit, the air conditioning apparatus further comprising a variable-capacity compressor connected in the refrigerant circuit.

12. The heat exchanger according to claim 1, wherein a lower end of the lower communication port is positioned further downward than a lower end of a lowest-stage flat tube, the lowest-stage flat tube being a flat tube arranged furthest downward above the vertical opening among the plurality of flat tubes connected to the first space.

13. The heat exchanger according to claim 12, wherein the header part has a header partition member partitioning the first space and the second space, a guide partition member partitions the guide space and the first space of the header part, an upper surface of the guide partition member includes a portion in contact with the header partition member, and the vertical opening passes through the guide partition member in a plate-thickness direction at a position spaced from a position of contact between the guide partition member and the header partition member.

14. An air conditioning apparatus including the heat exchanger of claim 13 connected in a refrigerant circuit, the air conditioning apparatus further comprising a variable-capacity compressor connected in the refrigerant circuit.

15. An air conditioning apparatus including the heat exchanger of claim 12 connected in a refrigerant circuit, the air conditioning apparatus further comprising a variable-capacity compressor connected in the refrigerant circuit.

16. The heat exchanger according to claim 1, wherein the header part has a header partition member partitioning the first space and the second space, a guide partition member partitions the guide space and the first space of the header part, an upper surface of the guide partition member includes a portion in contact with the header partition member, and the vertical opening passes through the guide partition member in a plate-thickness direction at a position spaced from a position of contact between the guide partition member and the header partition member.

17. An air conditioning apparatus including the heat exchanger of claim 16 connected in a refrigerant circuit, the air conditioning apparatus further comprising a variable-capacity compressor connected in the refrigerant circuit.

18. An air conditioning apparatus including the heat exchanger of claim 1 connected in a refrigerant circuit, the air conditioning apparatus further comprising a variable-capacity compressor connected in the refrigerant circuit.

* * * * *